United States Patent [19]

Sone et al.

[11] Patent Number: 4,859,287

[45] Date of Patent: Aug. 22, 1989

[54] METHOD FOR PRODUCING COLORED STAINLESS STEEL STOCK

[75] Inventors: Yuji Sone; Kayoko Wada; Hayao Kurahashi; Yoichi Nakai; Tetsu Narutani; Shigeharu Suzuki, all of Chiba, Japan

[73] Assignee: Kawasaki Steel Corporation, Kobe, Japan

[21] Appl. No.: 887,020

[22] PCT Filed: Nov. 22, 1985

[86] PCT No.: PCT/JP85/00647

§ 371 Date: Jul. 11, 1986

§ 102(e) Date: Jul. 11, 1986

[87] PCT Pub. No.: WO86/03229

PCT Pub. Date: Jun. 5, 1986

[30] Foreign Application Priority Data

| | | | |
|---|---|---|---|
| Nov. 22, 1984 | [JP] | Japan | 59-247542 |
| Dec. 10, 1984 | [JP] | Japan | 59-260497 |
| Sep. 11, 1985 | [JP] | Japan | 60-200821 |
| Sep. 11, 1985 | [JP] | Japan | 60-200822 |
| Sep. 11, 1985 | [JP] | Japan | 60-200823 |
| Sep. 11, 1985 | [JP] | Japan | 60-200824 |
| Sep. 11, 1985 | [JP] | Japan | 60-200825 |
| Oct. 31, 1985 | [JP] | Japan | 60-244783 |

[51] Int. Cl.[4] ..... C25D 9/04; C25D 11/34; C25D 11/38

[52] U.S. Cl. ..... 204/1 T; 204/28; 204/34; 204/56.1

[58] Field of Search ..... 204/34, 35.1, 37.6, 204/56.1, 28, 1 T

[56] References Cited

U.S. PATENT DOCUMENTS

| | | | |
|---|---|---|---|
| 3,929,593 | 12/1975 | Sugiyama et al. | 204/37.6 |
| 4,071,416 | 1/1978 | Sutton | 204/38.1 |
| 4,269,633 | 5/1981 | Takeuchi | 148/6.21 |
| 4,370,210 | 1/1983 | Yoshihara et al. | 204/140 |
| 4,427,499 | 1/1984 | Hitomi et al. | 204/27 |
| 4,659,437 | 4/1987 | Shiba et al. | 204/28 |

FOREIGN PATENT DOCUMENTS

| | | |
|---|---|---|
| 50-79447 | 6/1975 | Japan . |
| 52-4440 | 1/1977 | Japan . |
| 52-70948 | 6/1977 | Japan . |
| 53-16328 | 2/1978 | Japan . |
| 57-155395 | 9/1982 | Japan . |
| 60-2696 | 1/1985 | Japan . |

OTHER PUBLICATIONS

F. A. Lowenheim, Electroplating, McGraw-Hill Book Co., New York, 1978, pp. 152-155.

Metal Finishing Guidebook and Directory for 1978, Metals and Plastics Publications, Inc., Hackensack, NJ, pp. 168-170.

*Primary Examiner*—John F. Niebling
*Assistant Examiner*—William T. Leader
*Attorney, Agent, or Firm*—Young & Thompson

[57] ABSTRACT

A method for producing a chemically colored stainless steel stock widely used as building material or the like is characterized in that a stainless steel stock is subjected to alternating current electrolysis or dipped and then subjected to an electrolytic treatment in a coloring electrolyte solution containing ions comprising a metal having a plurality of valence numbers, thereby producing colored stainless steel stocks having a variety of colors in a uniform color tone by a single solution/single step process. The continuous production apparatus of the invention can continuously manufacture colored stainless steel stocks with a variety of colors by a single solution/single step process in a commercial scale without any troublesome operation while affording the ease of control of color tone.

22 Claims, 2 Drawing Sheets

METHOD FOR PRODUCING COLORED STAINLESS STEEL STOCK

TECHNICAL FIELD

This invention relates to a method for producing a colored stainless steel stock having improved abrasion resistance and minimized color shading and finding a major application as building material.

BACKGROUND OF THE INVENTION

Since colored stainless steel plates are mainly used as building material, they are required to have permissible wide color variation, color consistency or no color shading, and high abrasion resistance in addition to the corrosion resistance inherent to stainless steel.

To meet such requirements, there were proposed prior art techniques as shown below.

(1) Prior art known methods for imparting a wide variety of color tones to stainless steel stock are so called INCO methods primarily based on the use of a mixed solution of sulfuric acid plus chromic acid (see Japanese Patent Publication Nos. 52-32621, 52-25817, and 53-31817). These methods include two steps, "coloring" and "film hardening" steps, which are separately carried out with individual solution compositions, temperatures, and treating conditions. Most products are batchwise manufactured plates.

(2) When stainless steel is dipped in an aqueous solution comprising chromic acid and sulfuric acid, there forms a porous colored film of chromium oxides on the surface. This oxide film, however, is liable to abrasion because of porosity. Known methods for hardening such a colored film to overcome this problem are by effecting electrolysis in an aqueous solution containing chromic acid and a much lower concentration of sulfuric acid than in the coloring solution while setting the stainless steel plate colored by the aforementioned method as a cathode, thereby electrodepositing metallic chromium on the surface, as disclosed in Japanese Patent Publication Nos. 53-31817and 56-24040.

(3) Also disclosed is a method for continuously coloring stainless steel hoops (Japanese Patent Publication No. 60-22065). This method is to produce colored stainless steel strips by a dual step process based on the INCO method using dual solutions, "coloring" and "film hardening" tanks. Control of color tone is accomplished by measuring the potential between the steel strip and a counter electrode, platinum plate at a plurality of positions on the path of the strip in the "coloring" tank during the "coloring" step to compute a potential difference from a reference.

(4) Since the use of such sulfuric acid plus chromic acid solution leads to a great expenditure in the solution treatment required in view of pollution control, another coloring method is known involving dipping in sulfuric acid plus permanganate salt as a hexavalent chromium-free coloring solution (Japanese Patent Publication No. 51-40861). In this method, a dipping solution is prepared by adding a permanganate salt to aqueous sulfuric acid and allowing reaction to proceed until oxygen gas ceases to evolve, and stainless steel is dipped in the solution at a temperature in the range from 90° to 110° C., thereby forming a film colored in bronze, blackish brown or black color.

In addition to these solutions, a variety of coloring solutions have been developed. There is known a method for spontaneous coloring by dipping in a hot solution of sodium (or potassium) hydroxide plus potassium (or sodium) permanganate as one of such solutions (Japanese Patent Publication No. 54-30970).

However, the aforementioned prior art techniques have problems as described below.

The INCO method identified in (1) which consists of two steps, "coloring" and "film hardening" steps has the problems that water rinsing and drying operations must be inserted between the two "coloring" and "film hardening" steps in order to perform them in a continuous fashion; that because of a change of the originally imparted color during the "film hardening" step, the preceding "coloring" step requires a complicated adjustment to take into account the subsequent color change in order that the predetermined color be eventually obtained; and that dipping operations often used in the "coloring" treatment cannot avoid color shading at edges of colored articles.

The process is difficult to perform on an industrial continuous line because it is based on dual solution-dual step of "coloring treatment" and "film hardening treatment" and thus complicated.

The film hardening treatment identified in (2) requires two separate treating tanks for coloring and film hardening steps, and the need for water rinsing and drying between the coloring and film hardening steps makes the process complicated, resulting in color shading and low productivity. The cost of colored stainless steel is thus considerably increased and the use thereof is limited although there is a great potential demand as building materials (including interior and exterior materials).

Since a film hardening treatment solution used is different from a coloring solution, steel stock must be once taken out of the coloring tank before proceeding from the coloring step to the film hardening step. This leads to a problem of impairing aesthetic appearance, for example, occurrence of color shading.

The continuous coloring method identified in (3) accomplishes control of color tone on the basis of a potential difference with respect to a reference, and thus inevitably requires control of dipping time. This results in a complicated and difficult system wherein the speed of transfer of steel strip must be always changed by means of a winding motor. With respect to color tone, it is not easy to obtain products with the predetermined color because the "film hardening" treatment effected as the subsequent step inevitably invites a color change.

The immersion coloring in a mixed aqueous solution of sulfuric acid and permanganate salt identified in (4) suffers from the difficulty of solution maintenance because the process is carried out at a very high temperature of 90° to 110° C. so that the solution undergoes a substantial change of concentration due to evaporation. Evolution of vapors gives rise to a safety and hygienic problem to operators and a large sized exhaust disposal equipment must be installed, causing an increase of cost.

In the method of oxidative coloring with sodium hydroxide and potassium (or sodium) permanganate, the sodium (or potassium) hydroxide is used as an oxidation accelerator because the potassium (or sodium) permanganate alone has a weak oxidizing power. Black dyeing is achieved with immersion for 10 to 20 minutes at a solution temperature of 90° to 130° C. Since spontaneous immersion coloring with potassium (or sodium) permanganate and sodium (or potassium) hydroxide is carried out at a very high temperature of 90° to 130° C., the solution undergoes a substantial change of concentration due to evaporation, leading to difficulty in solution maintenance. Another problem is frequent color shading due to the high temperature treatment. The shortcoming of frequent color shading is critically detrimental to all applications including building and decorative materials. Industrial production cannot be applied unless this problem is solved.

DISCLOSURE OF THE INVENTION

An object of the present invention is to provide a method for producing a colored stainless steel stock whereby stainless steel stock can be colored to the desired color tone uniformly without color shading in high productivity while the colored steel exhibiting improved abrasion resistance and high quality can be manufactured by a single solution/single step process at a high efficiency of operation in a mass scale at low cost, as well as a continuous manufacturing apparatus therefor.

Such an object is achieved by the present invention as defined below.

Namely, a first aspect of the present invention is directed to a method for producing a colored stainless steel stock, characterized in that a stainless steel stock is subjected to alternating current electrolysis in a coloring electrolyte solution containing ions comprising a metal having a plurality of valence numbers, thereby coloring the stock.

A second aspect is directed to a method for producing a colored stainless steel stock, comprising subjecting a stainless steel stock which has been subjected to an electrolytic pickling treatment to alternating current electrolysis in a coloring electrolyte solution containing ions comprising a metal having a plurality of valence numbers, thereby coloring the stock, characterized in that said electrolytic pickling treatment is conducted in a solution containing 10 to 30% by weight of nitric acid and 0.5 to 5% by weight of phosphoric acid at 70° C. or lower, by a cathodic treatment at 0.5 to 2.0 A/dm$^2$ and a subsequent anodic treatment at 0.1 A/dm$^2$ or less.

A third aspect is directed to a method for producing a colored stainless steel stock, comprising subjecting a stainless steel stock to alternating current electrolysis in a coloring electrolyte solution containing ions comprising a metal having a plurality of valence numbers, thereby coloring the stock, characterized in that a color difference is detected by a color discriminating sensor provided at a colored steel stock outlet of an alternating current electrolytic tank, and electrolytic conditions in said tank are regulated in response to the detected value by way of control means.

A fourth aspect is directed to a method for producing a colored stainless steel stock, comprising subjecting a stainless steel stock which has been subjected to an electrolytic pickling treatment to alternating current electrolysis in a coloring electrolyte solution containing ions comprising a metal having a plurality of valence numbers, thereby coloring the stock, characterized in that said electrolytic pickling treatment is conducted in a solution containing 10 to 30% by weight of nitric acid and 0.5 to 5% by weight of phosphoric acid at 70° C. or lower, by a cathodic treatment at 0.5 to 2.0 A/dm$^2$ and a subsequent anodic treatment at 0.1 A/dm$^2$ or less, and a color difference is detected by a color discriminating sensor provided at a colored steel stock outlet of an alternating current electrolytic tank, and electrolytic conditions in said tank are regulated in response to the detected value by way of control means.

A fifth aspect is directed to a method for producing a colored stainless steel stock, characterized by comprising dipping a stainless steel stock in a coloring solution containing ions comprising a metal having a plurality of valence numbers to thereby color the stock and then effecting electrolysis in the same solution with the colored stainless steel stock made cathode.

A sixth aspect is directed to a method for producing a colored stainless steel stock, comprising dipping a stainless steel stock which has been subjected to an electrolytic picking treatment in a coloring solution containing ions comprising a metal having a plurality of valence numbers to thereby color the stock and then effecting electrolysis in the same solution with the colored stainless steel stock made cathode, characterized in that said electrolytic pickling treatment is conducted in a solution containing 10 to 30% by weight of nitric acid and 0.5 to 5% by weight of phosphoric acid at 70° C. or lower, by a cathodic treatment at 0.5 to 2.0 A/dm$^2$ and a subsequent anodic treatment at 0.1 A/dm$^2$ or less.

A seventh aspect is directed to an apparatus for continuously producing a colored stainless steel stock, characterized in that pre-treatment means for carrying out degreasing, pickling, and rinsing; alternating current electrolysis coloring means for carrying out a coloring treatment and a film hardening treatment in a single solution by a single step; and post-treatment means for rinsing and drying the colored steel stock are serially arranged.

An eighth aspect is directed to an apparatus for continuously producing a colored stainless steel stock, characterized by comprising pre-treatment means for carrying out degreasing, pickling, and rinsing; alternating current electrolysis coloring means for carrying out a coloring treatment and a hardening treatment in a single solution by a single step; post-treatment means for rinsing and drying the colored steel stock, said pre-treatment means, said coloring means, and said post-treatment means being serially arranged; a color discriminating sensor provided at a colored steel stock outlet of said alternating current electrolysis coloring means for detecting a color difference of the colored steel stock; and control means for regulating electrolytic conditions in said alternating current electrolysis coloring means in response to the detected color difference value of said color discriminating sensor.

Several preferred embodiments of the aforementioned first, second, third, fourth, seventh, and eighth aspects are described below.

(i) Said coloring electrolyte solution is a mixed aqueous solution containing at least 0.5 mol/liter calculated as hexavalent chromium of a chromium compound and at least 1 mol/liter of sulfuric acid, and said alternating current electrolysis is conducted at an anodic current density of 0.01 to 3.0 A/dm$^2$, a cathodic current density of 0.03 to 5.0 A/dm$^2$, is an aqueous and a frequency of up to 100 Hz.

(ii) Said coloring electrolyte solution is an aqueous solution of 30 to 75 wt % sulfuric acid to which 0.5 to 15 wt % calculated as $MnO_4^-$ of a permanganate salt is added for reaction, and said alternating current electrolysis is conducted at an anodic current density of 0.01 to 0.1 A/dm$^2$, a cathodic current density of 0.01 to 0.1 A/dm$^2$, and a frequency of up to 10 Hz.

(iii) Said coloring electrolyte solution is a mixed aqueous solution of 1 to 10 wt % of a permanganate salt and 30 to 50 wt % of an alkali metal or alkaline earth metal hydroxide, and said alternating current electrolysis is conducted at an anodic current density of 0.01 to 0.5 $A/dm^2$, a cathodic current density of 0.01 to 0.5 $A/dm^2$, and a frequency of up to 100 Hz.

(iv) Said coloring electrolyte solution is a mixed aqueous solution of 1 to 10 wt % of a permanganate salt, 30 to 50 wt % of an alkali metal or alkaline earth metal hydroxide, and 1 to 5 wt % of manganese dioxide, and said alternating current electrolysis is conducted at an anodic current density of 0.01 to 0.5 $A/dm^2$, a cathodic current density of 0.01 to 0.5 $A/dm^2$, and a frequency of up to 100 Hz.

(v) Said coloring electrolyte solution is a mixed aqueous solution containing 0.5 to 2 mol/liter calculated as hexavalent molybdenum of a molybdenum compound, 1 to 5 mol/liter of sulfuric acid, and 0.5 to 2 mol/liter calculated as hexavalent chromium of a chromium compound, and said alternating current electrolysis is conducted at an anodic current density of 0.01 to 0.5 $A/dm^2$, a cathodic current density of 0.01 to 0.5 $A/dm^2$, and a frequency of up to 10 Hz.

(vi) Said coloring electrolyte solution is a mixed aqueous solution containing 0.5 to 1.5 mol/liter calculated as pentavalent vanadium of a vanadium compound and 5 to 10 mol/liter of sulfuric acid, and said alternating current electrolysis is conducted at an anodic current density of 0.01 to 0.2 $A/dm^2$, a cathodic current density of 0.01 to 0.2 $A/dm^2$, and a frequency of up to 10 Hz.

(vii) Said alternating current electrolysis is conducted in an alternating current electrolytic tank using a stainless steel stock as a counter electrode.

Several preferred embodiments of the aforementioned fifth and sixth aspects are described below.

(viii) Said coloring solution is a mixed aqueous solution containing 0.5 to 5 mol/liter calculated as hexavalent chromium of a chromium compound and 1 to 7.2 mol/liter of sulfuric acid, and said electrolysis is conducted at a cathodic current density of up to 0.5 $A/dm^2$.

(ix) Said coloring solution is an aqueous solution of 30 to 75 wt % sulfuric acid to which 0.5 to 15 wt % calculated as $MnO_4^-$ of a permanganate salt is added for reaction, and said electrolysis is conducted at a cathodic current density of up to 0.1 $A/dm^2$.

(x) Said coloring solution is a mixed aqueous solution of 1 to 10 wt % of a permanganate salt and 30 to 50 wt % of an alkali metal or alkaline earth metal hydroxide, and said electrolysis is conducted at a cathodic current density of up to 0.5 $A/dm^2$.

(xi) Said coloring solution is a mixed aqueous solution of 1 to 10 wt % of a permanganate salt, 30 to 50 wt % of an alkali metal or alkaline earth metal hydroxide, and 1 to 5 wt % of manganese dioxide, and said electrolysis is conducted at a cathodic current density of up to 0.5 $A/dm^2$.

(xii) Said coloring solution is a mixed aqueous solution containing 0.5 to 2 mol/liter of hexavalent molybdenum, 1 to 5 mol/liter of sulfuric acid, and 0.5 to 2 mol/liter of hexavalent chromium, and said electrolysis is conducted at a cathodic current density of up to 0.2 $A/dm^2$.

(xiii) Said coloring solution is a mixed aqueous solution containing 0.5 to 1.5 mol/liter calculated as pentavalent vanadium of a vanadium compound and 5 to 10 mol/liter of sulfuric acid, and said electrolysis is conducted at a cathodic current density of up to 0.2 $A/dm^2$.

One preferred embodiment of the aforementioned seventh and eighth aspects is described below. (xiv) Pickling treatment means in said pre-treatment means comprises as a pickling solution a solution containing 10 to 30% by weight of nitric acid and 0.5 to 5% by weight of phosphoric acid at 70° C. or lower, and is designed to conduct a cathodic treatment at 0.5 to 2.0 $A/dm^2$ and a subsequent anodic treatment at 0.1 $A/dm^2$, or less.

Numeral 1 designates a stainless steel strip, 2 an uncoiler, 3 a degreasing tank, 4 a hot water rinse tank, 5 a pickling tank, 6 a hot water rinse tank, 7 a conductor roll, 8 an alternating current electrolytic tank, 9 a counter electrode, 10 a guide roll, 11 a color discriminating sensor, 12 a control computer, 13 a hot water rinse tank, 14 a hot water rinse tank, 15 a dryer, 16 a protective sheet, 17 a take-up roll, 18 a chromic acid regenerating tank, 19 a chromic acid waste disposal unit, 20 an anodic electrolysis time, 21 an electrolytic anodic current density, 22 a cathodic electrolysis time, and 23 an electrolytic cathodic current density.

DETAILED DESCRIPTION OF THE INVENTION

The illustrative construction of the present invention will now be described in greater detail.

Figure 1:
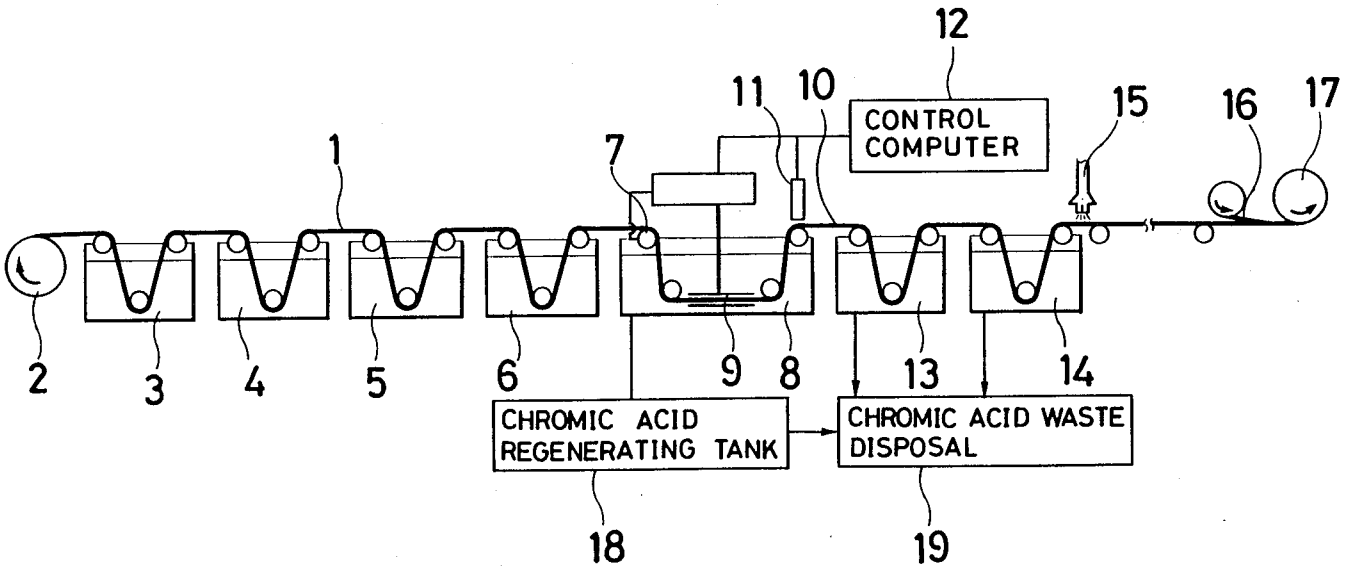
FIG. 1 is a schematic view illustrating one embodiment of the apparatus for the continuous manufacture of a colored stainless steel stock according to the present invention for continuously producing a colored stainless steel stock using a hexavalent chromium-containing solution.

One example of a line for continuously applying a coloring treatment to a stainless steel stock by an alternating current electrolysis process is shown in FIG. 1.

The term stainless steel stocks used herein may have any desired contours including wires, pipes, plates, masses, profiles, and granules although the following description refers to a steel strip as a typical stock.

As shown in FIG. 1, a stainless steel strip 1 is unwound from an uncoiler 2, removed of surface-adhered contaminants such as oil to render the surface uniform in pre-treatment units 3 to 6, and then admitted into an alternating current electrolytic tank 8 through a conductor roll 7. The tank has a counter electrode 9. Alternating current electrolysis is effected between the counter electrode 9 and the stainless steel strip 1 to color the strip, which exits from the electrolytic tank 8.

In the practice of the present invention, a color discriminating sensor 11 is preferably located near a guide roll 10 at the exit of the electrolytic tank 8 to measure the color tone of the colored stainless steel strip. For the color tone measurement purpose, the solution entrained on the stainless steel strip 1 may be removed, for example, by blowing pressurized air. The color discriminating sensor used may be a remote sensor or the like.

Figure 2:
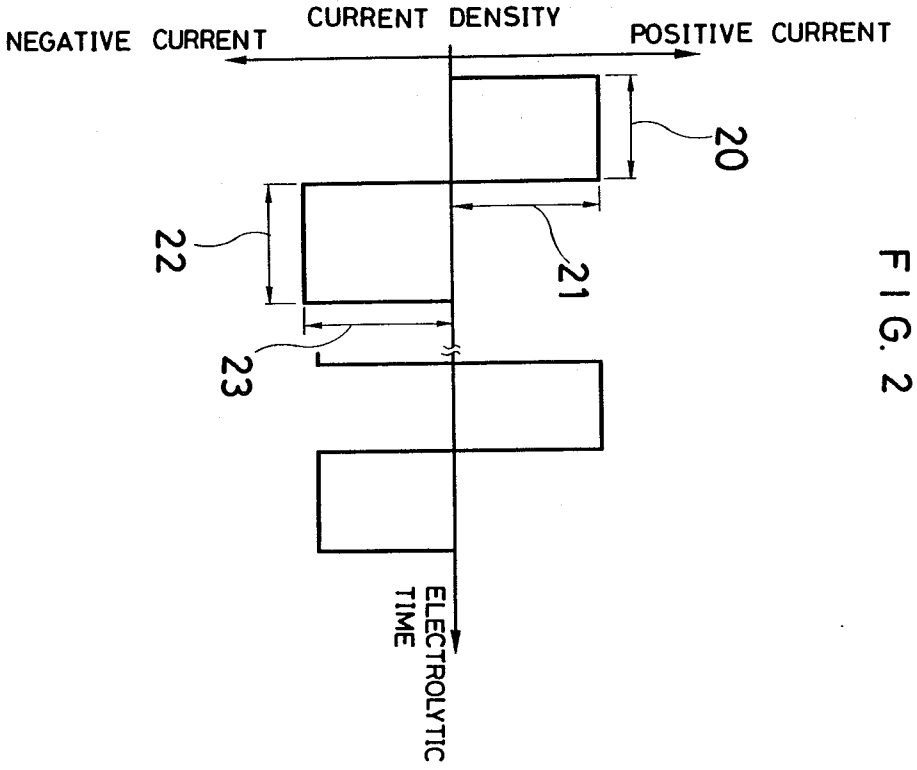
FIG. 2 illustrates the concept of a method for producing a colored stainless steel stock by alternating current electrolysis wherein anodic electrolysis and cathodic electrolysis are alternately carried out. The ordinate represents electrolytic current density and the abscissa represents electrolysis time.

The resulting data of color tone measurement (color may be represented using color difference according to JIS Z 8730) are supplied to a control computer 12. When an input is in excess of the preset limit of color difference, a feedback is made in current density, electrolytic time, frequency or electrolysis frequency number, bath temperature and other electrolytic conditions for anodic electrolysis and cathodic electrolysis to provide coloring control. In FIG. 2, there are shown electric current i, electrolytic time t, and electrolysis frequency N as electrolytic conditions. It is unnecessary to change the web transfer speed as done in prior techniques.

The stainless steel strip 1 in which the predetermined color tone has been established in this way is then passed through two downstream hot water rinse tanks 13 and 14 where the solution remaining on its surface is fully rinsed away, and its surface is then dried with hot air blown from a dryer 15 outside the tank. Thereafter, the strip is wound on a take-up roll 17 while preferably inserting a protective sheet 16 between turns.

Depending on the disposition or actuation of the counter electrode 9 in the alternating current electrolytic tank 8, the stainless steel strip 1 may be colored on its single surface as well as double surface coloring. That is, when both the surfaces of the stainless steel strip 1 are to be colored, the counter electrodes 9 on the opposite sides of the strip 1 are actuated. When only one surface of the stainless steel strip 1 is to be colored, the counter electrode 9 on one side of the strip 1 is actuated. A stainless steel strip may be used as the counter electrode 9.

As mentioned above, the present invention permits a continuous stable coloring treatment on a stainless steel strip by a single solution/single step process which has never been realized in the prior art.

A pre-treatment method used in the manufacture of colored stainless steel stocks according to the present invention will now be described.

In general, as a pre-treatment used in the manufacture of colored stainless steel stocks, degreasing with alkali and pickling with acid are performed usually by dipping in order to remove oil, grease, and adhesive.

These treatments are essentially intended for contaminant removal, but not for surface film uniformity.

With the uniformity of surface film and the convenience of actual operation borne in mind, the present inventors have made a series of electrochemical investigations on the basis of the essential acknowledgement of performing a pickling treatment by electrolysis, and found that chemically colored stainless steel strips having a uniform color tone with minimized color shading are obtained by conducting a continuous pre-treatment comprising a first cathodic treatment followed by an anodic treatment in a nitric acid-based solution and successively conducting a coloring treatment by an alternating current electrolysis process.

The electrolytic pickling will now be described with respect to its solution and operating conditions. It should be noted that in the following description, all percents are percents by weight.

(1) Electrolytic pickling solution

A solution containing 10 to 30% of nitric acid plus 0.5 to 5% of phosphoric acid is preferably used as the electrolytic pickling solution. The content of nitric acid is limited to 10 to 30% because less than 10% is short of oxidizing power to form a satisfactory surface passive film and the effect is saturated in excess of 30%.

The addition of phosphoric acid prevents excessive evolution of hydrogen gas during the cathodic treatment, rendering the surface film uniform during the anodic treatment. To this end, at least 0.5 % is necessary while the upper limit is preferably set to 5% because the effect is lost in excess of 5%.

The solution temperature is limited to 70° C. because steel strips undergo severe roughening at temperatures in excess of 70° C. The preferred lower limit is about 20° C.

(2) Cathodic treatment conditions in electrolytic pickling

With respect to cathodic treatment conditions, at least 0.5 A/dm$^2$, is necessary in order to clean the stainless steel surface with a sufficient amount of hydrogen gas bubbles whereas in excess of 2.0 A/dm$^2$, polarization occurs to such a greater extent that hydrogen embrittlement cracking would be induced in some ferritic stainless steels. The preferred range is from 0.5 A/dm$^2$, to 2.0 A/dm$^2$.

(3) Anodic treatment conditions in electrolytic pickling

The anodic treatment is conducted to form a homogeneous passive film on the surface which has been cleaned by the cathodic treatment. It is essential for this purpose to conduct the anodic treatment at a low current density of up to 0.1 A/dm$^2$, beyond which Cr and Fe are dissolved out mainly from grain boundaries to give rise to surface roughening, impairing homogeneity. The preferred range is 0.1 A/dm$^2$ or lower.

Since most prior art treatments are based on dipping, it is difficult to control the rate or kinetics of reaction taking place at the metal-solution interface. The electrolytic pickling treatment according to the present invention wherein control of pickling conditions can be made in terms of such factors as current density and time is a process which is suitable for the pre-treatment of a length or coil of steel prior to chemical coloring and accommodates with any chemical compositions and surface finish of stainless steel.

After a pre-treatment has been applied to the stainless steel strip by electrolytic pickling as described above, coloring of the steel strip is done by an alternating current electrolysis process Namely, alternating current electrolysis is applied to the stainless steel strip in a coloring electrolyte solution containing ions comprising a metal having a plurality of valence numbers, achieving coloring.

The coloring of stainless steel strip by the alternating current electrolysis process is a process to simultaneously effect coloring and film hardening by alternately changing the polarity of electricity applied to the stainless steel strip on the basis of the principle that coloring is done by anodic electrolysis and film hardening is done by cathodic electrolysis. That is, coloring of a stainless steel strip can be accomplished in a single solution/single step process.

The application of alternating current to the stainless steel strip is illustrated in FIG. 2, from which the rectangular wave form of the applied alternating current will be seen. In the figure, the ordinate represents electrolytic current density and the abscissa represents electrolytic time. Numeral 20 designates an anodic electrolysis time, 21 an anodic electrolysis current density, 22 a cathodic electrolysis time, and 23 a cathodic electrolysis current density.

In the practice of the invention, with adequately combined current densities and electrolytic times for anodic and cathodic electrolysis, alternating current electrolysis is effected by predetermined cycles in the electrolytic solution.

In the practice of the invention, it is possible to carry out the coloring and film hardening treatment on the stainless steel strip by a combination of alternating current electrolysis and pulse current electrolysis as well as by alternating current electrolysis alone as mentioned above. That is, pulse current electrolysis may be effected at least once during or after the alternating current electrolysis.

Several examples of the electricity conducting pattern used in such cases are given below as patterns (1) to (8).

(1) alternating current - positive pulse current-alternating current.
(2) alternating current - negative pulse current-alternating current.
(3) alternating current - positive pulse current-negative pulse current - alternating current
(4) alternating current - negative pulse current.
(5) alternating current - positive pulse current-alternating current - negative pulse current
(6) alternating current - positive pulse current-negative pulse current.
(7) repeating one of patterns (1) to (6) plural times.
(8) combining more than one of patterns (1) to (6).

It should be noted that in all these electricity conducting patterns, the last applied electric current must be alternating current or negative pulse current in order that a film hardening be effected at last.

It will be understood that the intensity of positive and negative currents, conducting cycle, and conducting time may be suitably chosen.

Although the mechanism in which the stainless steel strip is subjected to coloring and film hardening by such positive and negative pulse current electrolysis is not necessarily clearly understood, it is presumed that the application of positive pulse current promotes the growth of spinel crystals to form a film on the stainless steel surface and the application of negative pulse current provides a sealing action on the grown spinel crystals of a columnar structure, thereby homogenizing the film to harden it.

The coloring electrolyte solution used is a solution containing ions comprising a metal having a plurality of valence numbers. Examples of the ions include water-soluble ions such as $Cr^{6+}$, $MnO_4^-$, $MoO_4^{2-}$, $V^{5+}$ [$MV0_3$ (metavanadate), $M_4V_2O_7$ (pyrovanadate), and $M_3VO_4$ (orthovanadate) where M is a monovalent cation], and the like.

Thus, any proper choice may be made over a wide range with respect to the composition of the coloring electrolyte solution and the electrolytic conditions of the alternating current electrolysis (including anodic current density, cathodic current density, frequency, etc.) in the practice of the present invention.

The composition of the coloring electrolyte solution and electrolytic conditions are further described by illustrating some preferred examples.

It should be noted that the present invention is not limited to the following illustrative examples.

[1] In a mixed aqueous solution containing at least 0.5 mol/liter calculated as hexavalent chromium of a chromium compound and at least 1 mol/liter of sulfuric acid, alternating current electrolysis is performed at an anodic current density of 0.01 to 3.0 A/dm$^2$, a cathodic current density of 0.03 to 5.0 A/dm$^2$, and a frequency of up to 100 Hz.

Typical examples of the chromates used to provide hexavalent chromium include water-soluble compounds such as chromic anhydride, sodium dichromate, potassium dichromate, and the like.

The composition of the coloring electrolyte solution is limited to the above-mentioned range for the following reason.

Less than 0.5 mol/liter of hexavalent chromium is short of oxidizing power and thus takes a long time to achieve coloring and fails to provide sufficient abrasion resistance. Less than 1 mol/liter of sulfuric acid takes a long time to complete a coloring treatment.

The conditions of the alternating current electrolysis are limited to the above-mentioned ranges for the following reason.

(1) Anode electrolytic current density

No coloring occurs at an anode electrolytic current density of less than 0.01 A/dm$^2$. A uniform film having an interference color cannot be formed in excess of 3.0 A/dm$^2$. The anode electrolytic current density is thus limited to the range of 0.01 to 3.0 A/dm$^2$.

(2) Cathode electrolytic current density

Films formed at a cathode electrolytic current density of less than 0.03 A/dm$^2$ will readily peel off in an abrasion test as will be described later. Steel strips treated at 5.0 A/dm$^2$ or higher display metallic luster over the entire surface and are thus not considered to be colored steel strips. The cathode electrolytic current density is thus limited to the range of 0.03 to 5.0 A/dm$^2$.

(3) Frequency

Since no coloring is conferred at an electrolysis frequency of more than 100 Hz, the preferred frequency is 100 Hz or less.

With respect to color tone adjustment, any desired interference color may be obtained by suitably selecting the electrolysis frequency, anodic current density, and electrolytic time within the specific ranges conforming to the above-mentioned requirements (1) to (3). [2] In an aqueous solution of 30 to 75 wt % sulfuric acid to which 0.5 to 15 wt % calculated as $MnO_4^-$ of a permanganate salt is added for reaction, preferably at a temperature range of from 40° to 100° C., the stainless steel strip is subjected to alternating current electrolysis at an anodic current density of 0.01 to 0.1 A/dm$^2$, a cathodic current density of 0.01 to 0.1 A/dm$^2$, and a frequency of up to 10 Hz.

This embodiment has the advantages of ease and inexpensiveness of waste liquid disposal in view of pollution control because the coloring electrolyte solution used does not contain chromic acid (hexavalent chromium) as opposed to the foregoing embodiment [1].

The composition of the coloring electrolyte solution is limited to the above-mentioned range for the following reason.

(1) Sulfuric acid

Less than 30% by weight of sulfuric acid fails to achieve a sufficient coloring effect whereas more than 75% by weight provides a coloring effect, but makes it difficult to control because of too fast reaction. The concentration of sulfuric acid is thus limited to the range of from 30 to 75% by weight.

(2) Permanganate salt

When the amount of a permanganate salt added to the sulfuric acid solution is less than 0.5% by weight calculated as $MnO_4^-$, the resulting solution has a weak coloring power and a short effective life. The coloring power is saturated in excess of 15% by weight. The permanganate salt is thus limited to the range from 0.5 to 15% by weight of $MnO_4^-$. It is to be noted that examples of the permanganate salts used herein include permanganates of potassium, sodium, lithium, rubidium, silver, magnesium and the like.

(3) Temperature

Temperatures of lower than 40° C. undesirably result in poor reactivity and little coloring whereas temperatures of higher than 100° C. undesirably tend to invite color shading and cause a substantial volume of vapor to generate. The temperature of the electrolytic solution is thus limited to the range of from 40° to 100° C.

The conditions of the alternating current electrolysis are limited to the above-mentioned ranges for the following reason.

(1) Anode electrolytic current density

No coloring occurs at lower than 0.01 A/dm$^2$. A uniform film without color shading cannot be formed in excess of 0.1 A/dm$^2$. The anode electrolytic current density is thus limited to the range of 0.01 to 0.1 A/dm$^2$.

(2) Cathode electrolytic current density

Films formed at lower than 0.01 A/dm$^2$ are very brittle whereas no colored films are obtained in excess of 0.1 A/dm$^2$. The cathode electrolytic current density is thus limited to the range of 0.01 to 0.1 A/dm$^2$.

(3) Frequency

Since no coloring is conferred at an electrolysis frequency of more than 10 Hz, the preferred frequency is 10 Hz or less.

Stainless steel strips colored in bronze, blackish brown, gold or the like are obtained by alternately repeating anodic electrolysis and cathodic electrolysis under the aforementioned conditions to provide coloring. [3] a. In a mixed aqueous solution of 1 to 10 wt % of a permanganate salt and 30 to 50 wt % of an alkali metal or alkaline earth metal hydroxide, preferably at a temperature range of 40° to 90° C., alternating current electrolysis is conducted at an anodic current density of 0.01 to 0.5 A/dm$^2$, a cathodic current density of 0.01 to 0.5 A/dm$^2$, and a frequency of up to 100 Hz.

b. In a mixed aqueous solution of 1 to 10 wt % of a permanganate salt, 30 to 50 wt % of an alkali metal or alkaline earth metal hydroxide, and 1 to 5 wt % of manganese dioxide, preferably at a temperature range of 40° to 90° C., alternating current electrolysis is conducted at an anodic current density of 0.01 to 0.5 A/dm$^2$, a cathodic current density of 0.01 to 0.5 A/dm$^2$, and a frequency of up to 100 Hz.

In the case of simple dip coloring, color shading occurs because of the elevated temperature of the dipping solution as high as about 90° to 130° C., and solution maintenance is difficult because of a violent change in solution concentration The above-mentioned embodiments a and b have overcome these drawbacks.

Preferred examples of the permanganate salts include permanganates of potassium, sodium, calcium and the like, and preferred examples of the alkali or alkaline earth metal hydroxides include hydroxides of potassium, sodium, calcium and the like.

(1) Solution composition

The preferred composition range of the coloring electrolyte solution is given below.

| | |
|---|---|
| Permanganate salt (a and b) | 1–10 wt % |
| Alkali or alkaline earth metal hydroxide (a and b) | 30–50 wt % |
| Manganese dioxide (b) | 1–5 wt % |
| Water (a and b) | balance |

The reason of limitation is set forth below.

Less than 1 wt % of permanganate salt is short of oxidizing power and thus fails to provide coloring whereas no additional effect is derived in excess of 10 wt %. The range of 1 to 10 wt % is thus adequate.

For the same reason, 1 to 5 wt % of manganese dioxide is adequate.

Less than 30 wt % of alkali or alkaline earth metal hydroxide fails to provide a sufficient function as an oxidation promotor whereas the color tends to be speckled in excess of 50 wt %. The range of 30 to 50 wt % is thus adequate.

(2) Solution temperature

Temperatures of lower than 40° C. result in poor reactivity and take a long time to complete coloring whereas temperatures of higher than 90° C. give rise to color shading and evaporation. The preferred temperature range is from 40° to 90° C.

(3) Electrolytic conditions

Preferred conditions under which alternating current electrolysis is conducted include an anodic current density of 0.01 to 0.5 A/dm$^2$ and a cathodic current density of 0.01 to 0.5 A/dm$^2$, and the electrolysis is alternately conducted at a frequency of up to 100 Hz. No coloring occurs at an anodic current density of less than 0.01 A/dm$^2$, whereas a uniform film without color shading cannot be obtained in excess of 0.5 A/dm$^2$. The range of 0.01 to 0.5 A/dm$^2$ is thus adequate.

Films formed at a cathodic current density of less than 0.01 A/dm$^2$are brittle whereas no coloring occurs in excess of 0.5 A/dm$^2$. The range of 0.01 to 0.5 A/dm$^2$ is thus adequate. Coloring becomes difficult at frequencies in excess of 100 Hz, the preferred frequency is 100 Hz or lower.

[4] In a mixed aqueous solution containing 0.5 to 1.5 mol/liter calculated as pentavalent vanadium of a vanadium compound and 5 to 10 mol/liter of sulfuric acid, alternating current electrolysis is conducted at an anodic current density of 0.01 to 0.2 A/dm$^2$, a cathodic current density of 0.01 to 0.2 A/dm$^2$, and a frequency of up to 10 Hz.

Typical examples of the compounds used to provide pentavalent vanadium are water-soluble compounds such as sodium vanadate.

The composition of the coloring electrolyte solution is limited to the above-mentioned range for the following reason.

(1) Pentavalent vanadium (vanadate compounds)

Less than 0.5 mol/liter of pentavalent vanadium is short of oxidizing power and thus takes a long time to achieve coloring and fails to provide sufficient abrasion resistance. The effect is saturated in excess of 1.5 mol/liter.

(2) Sulfuric acid

Less than 0.5 mol/liter takes a long time to complete a coloring treatment whereas more than 10 mol/liter fails to provide uniform coloring, sufficient film hardening, and good abrasion resistance.

The conditions of the alternating current electrolysis are limited to the above-mentioned ranges for the following reason.

(1) Anodic current density

No coloring occurs at lower than 0.01 A/dm$^2$ whereas a uniform film without color shading cannot be formed in excess of 0.2 A/dm$^2$. The anodic current density is thus limited to the range of 0.01 to 0.2 A/dm$^2$.

(2) Cathodic current density

Films formed at lower than 0.01 A/dm$^2$ are very brittle whereas no colored films are obtained in excess of 0.2 A/dm$^2$. The cathodic current density is thus limited to the range of 0.01 to 0.2 A/dm$^2$.

(3) Frequency

Since no coloring is conferred in excess of 10 Hz, the preferred frequency is 10 Hz or less.

[5] In a mixed aqueous solution containing 0.5 to 2.0 mol/liter calculated as hexavalent molybdenum of a molybdenum compound, 0.5 to 2.0 mol/liter calculated as hexavalent chromium of a chromium compound (e.g., chromic acid), and 1 to 5 mol/liter of sulfuric acid, alternating current electrolysis is conducted at an anodic current density of 0.01 to 0.5 A/dm$^2$, a cathodic current density of 0.01 to 0.5 A/dm$^2$, and a frequency of up to 10 Hz.

Typical examples of the compounds used to provide hexavalent molybdenum are water-soluble compounds such as $MoO_3$, $Na_2MoO_4$, etc.

The composition of the coloring electrolyte solution is limited to the above-mentioned range for the following reason.

(1) Hexavalent molybdenum (molybdate compounds)

Less than 0.5 mol/liter of hexavalent molybdenum is short of oxidizing power and thus takes a long time to achieve coloring and fails to provide sufficient abrasion resistance. The effect is saturated in excess of 2.0 mol/liter.

(2) Hexavalent chromium (chromic acid)

Less than 0.5 mol/liter of hexavalent chromium is short of oxidizing power and thus takes a long time to achieve coloring and fails to provide sufficient abrasion resistance. The effect is saturated in excess of 2.0 mol/liter.

(3) Sulfuric acid

Less than 1 mol/liter takes a long time to complete a coloring treatment whereas more than 5 mol/liter fails to provide uniform coloring, sufficient film hardening, and good abrasion resistance.

The conditions of the alternating current electrolysis are limited to the above-mentioned ranges for the following reason.

(1) Anodic current density

No coloring occurs at lower than 0.01 A/dm$^2$ whereas a uniform film without color shading cannot be formed in excess of 0.5 A/dm$^2$. The anodic current density is thus limited to the range of 0.01 to 0.5 A/dm$^2$.

(2) Cathodic current density

Films formed at lower than 0.01 A/dm$^2$are very brittle whereas no colored films are obtained in excess of 0.5 A/dm$^2$. The cathodic current density is thus limited to the range of 0.01 to 0.5 A/dm$^2$.

(3) Frequency

Since no coloring is conferred in excess of 10 Hz, the preferred frequency is 10 Hz or less.

In the foregoing embodiments of coloring a stainless steel strip by alternating current electrolysis, a stable metal (for example, C, Pt, Pb, Ti, Pb-Sn alloy, etc.) is generally used as the counter electrode 9 relative to the stainless steel strip.

Since the alternating current electrolysis is characterized in that cycles of anodic electrolysis and cathodic electrolysis are repeated on the counter electrode 9 as well as on a workpiece to be colored, the use of a counter electrode of the same material permits efficient utilization of the alternating current electrolysis on the counter electrode, resulting in improved productivity.

It is thus preferable to use a stainless steel stock as the counter electrode 9 in the alternating current electrolytic tank 8. The stainless steel used as the counter electrode is converted into colored one similar to the colored workpiece, and no difference is observed between the resultant two colored stainless steel strips with respect to the properties of color tone and abrasion resistance.

The present method may be applied to either a batchwise or continuous system. In the batchwise system, at least one set each consisting of a pair of sheets may be placed where a coloring treatment is carried out. In the continuous system, two or more stainless steel stocks may be passed in an opposed relationship and subjected to a coloring treatment at the same time.

Although the method for coloring a stainless steel stock by a single solution/single step process using alternating current electrolysis has been described, the present invention also involves a method for making a colored stainless steel stock by an single solution/single step process without alternating current electrolysis.

That is, also contemplated is a method for making a colored stainless steel stock, comprising dipping a stainless steel stock in a coloring solution containing ions comprising a metal having a plurality of valence numbers to thereby color the stock (in an electroless manner) and then effecting electrolysis in the same solution with the colored stainless steel stock made cathode.

This method can also overcome the drawbacks of the prior art techniques based on dual solution/dual step process as previously mentioned while preventing occurrence of color shading and simplifying the manufacturing process.

Also in this method, a proper choice may be made over a wide range with respect to the composition of the coloring solution and the conditions (cathodic current density, etc.) of the electrolytic treatment to be effected with the stainless steel stock made cathode.

The composition of the coloring solution and electrolytic conditions are further described by illustrating some preferred examples It should be noted that the present invention is not limited to the following illustrative examples.

[1] The coloring solution is a mixed aqueous solution containing 0.5 mol/liter to 5 mol/liter of hexavalent chromium and 1.0 mol/liter to 7.2 mol/liter of sulfuric acid at a temperature of 30° to 90° C., and cathodic electrolysis is conducted under conditions, a current density of up to 0.5 A/dm$^2$.

The reasons of limitation of these values are given below.

(1) Coloring solution composition

Hexavalent chromium:

Less than 0.5 mol/liter of hexavalent chromium is short of oxidizing power and thus takes a long time to achieve coloring, while failing to provide sufficient abrasion resistance during the film hardening treatment.

The addition of hexavalent chromium in excess of 5 mol/liter provides little additional effect and is thus uneconomical.

$H_2SO_4$:

Less than 1.0 mol/liter is impractical because it takes a long time to complete coloring in the coloring treatment.

The addition of sulfuric acid in excess of 7.2 mol/liter fails to provide uniform coloring, while failing to provide satisfactory abrasion resistance during the film hardening treatment.

(2) Solution temperature

Temperatures of lower than 30° C. are impractical because of enhanced coloring reaction. At temperatures of higher than 90° C., evaporation of the solution occurs to such an extent that the maintenance of solution concentration becomes difficult.

(3) Cathode electrolytic current density

When electrolysis is effected at a current density in excess of 0.5 A/dm$^2$, abrasion resistance is rather lowered and the color that has been developed during the coloring step undergoes a substantial change in the electrolysis step to make color tone control difficult.

[2] The coloring solution is an aqueous solution of 30 to 75 wt % sulfuric acid to which 0.5 to 15 wt % calculated as $MnO_4^-$ of a permanganate salt is added for reaction, preferably at a temperature range of 40° to 100° C., and the electrolytic condition is a cathodic current density of up to 0.1 A/dm$^2$.

The reasons of limitation of the composition and temperature of the coloring solution are the same as in embodiment [2] of the former aspect of the present invention having alternating current electrolysis involved.

The cathodic current density is limited to 0.1 A/dm$^2$ or less because a current density below this limit results in good abrasion resistance.

[3] a. The coloring solution is a mixed aqueous solution of 1 to 10 wt % of a permanganate salt and 30 to 50 wt % of an alkali metal or alkaline earth metal hydroxide, and the electrolytic condition is a cathodic current density of up to 0.5 A/dm$^2$.

b. The coloring solution is a mixed aqueous solution of 1 to 10 wt % of a permanganate salt, 30 to 50 wt % of an alkali metal or alkaline earth metal hydroxide, and 1 to 5 wt % of manganese dioxide, and the electrolytic condition is a cathodic current density of up to 0.5 A/dm$^2$.

The reason of limitation of the composition of the coloring solution is the same as in embodiments [3]-a and b of the former aspect of the present invention having alternating current electrolysis involved.

The cathodic current density is limited to 0.5 A/dm$^2$ or less because a current density in excess of 0.5 A/dm$^2$ results in deteriorated abrasion resistance.

[4] The coloring solution is a mixed aqueous solution containing 0.5 to 1.5 mol/liter of pentavalent vanadium and 5 to 10 mol/liter of sulfuric acid, and the electrolytic condition is a cathodic current density of up to 0.2 A/dm$^2$. The reason of limitation of the composition of the coloring solution is the same as in embodiment [4] of the former aspect of the present invention having alternating current electrolysis involved.

The cathodic current density is limited to 0.2 A/dm$^2$ or less because this range ensures good abrasion resistance.

[5] The coloring solution is a mixed aqueous solution containing 0.5 to 2 mol/liter of hexavalent molybdenum, 1 to 5 mol/liter of sulfuric acid, and 0.5 to 2 mol/liter of hexavalent chromium, and the electrolytic condition is a cathodic current density of up to 0.5 A/dm$^2$. The reason of limitation of the composition of the coloring solution is the same as in embodiment [5] of the former aspect of the present invention having alternating current electrolysis involved.

The cathodic current density is limited to 0.5 A/dm$^2$ or less because this range ensures good abrasion resistance.

The method for making a colored stainless steel stock, comprising dipping a stainless steel stock in a coloring solution to thereby color the stock and then effecting cathodic electrolysis to accomplish a film hardening treatment as mentioned above may also be preceded by a combination of pre-treatments as previously described. Then there are obtained colored stainless steel strips with little color shading.

Next, the apparatus for continuously producing a colored stainless steel stock according to the present invention will be detailed by referring to the preferred embodiment shown in FIG. 1.

In the continuous manufacture apparatus of colored stainless steel stock as shown in FIG. 1, the series of degreasing tank 3—hot water rinse tank 4—pickling tank 5—hot water rinse tank 6 arranged for pre-treatments are followed by alternating current electrolytic tank 8 wherein coloring and film hardening are accomplished by a single solution/single step process, and the series of hot water rinse tank 13—hot water rinse tank 14—dryer 15 arranged for post-treatments are located downstream thereof.

Pickling in the pickling tank 5 may be done by a conventional technique although it is preferred to charge the pickling tank 5 with a solution containing 10 to 30% by weight of nitric acid and 0.5 to 5% by weight of phosphoric acid at 70° C. or lower as the pickling solution, and to effect a cathodic treatment at 0.5 to 2.0 A/dm$^2$ and subsequently an anodic treatment at 0.1 A/dm$^2$ or lower. In the alternating current electrolytic tank 8, alternating current electrolysis may be conducted using any coloring electrolyte solutions having a variety of compositions under any electrolytic conditions as previously described.

The alternating current electrolytic tank 8 has disposed therein the counter electrode 9 for applying alternating current to the stainless steel strip 1. The counter electrode 9 may be formed of a stable metal, for example, C, Pt, Pb, Ti, Pb-Sn alloy, etc. although the use of a stainless steel stock is preferred because it is also colored, resulting in increased productivity.

The use of stainless steel stock as the counter electrode may be applied to either a batchwise or continuous system. In the batchwise system, at least one set each consisting of a pair of sheets may be placed where a coloring treatment is carried out. In the continuous system, two or more stainless steel sheets may be passed in an opposed relationship and subjected to a coloring treatment at the same time.

A color discriminating sensor 11, for example, a remote sensor is located on the outlet side of the alternating current electrolytic tank 8 and connected to an input terminal of a computer 12 for controlling electrolytic conditions. That is, provision is made such that the information detected by the color discriminating sensor 11 is supplied at any time to the computer 12. The alternating current electrolytic tank 8 is further provided with means connected to an output terminal of the computer 12 for changing electrolytic conditions (including current densities i and times t for anodic electrolysis and cathodic electrolysis, electrolysis frequency N, solution concentration, bath temperature, and the like) in response to an output signal of the computer 12. The computer 12 produces a command signal instructing to change and adjust respective electrolytic conditions, by which the respective electrolytic conditions are accordingly adjusted to optimum values. The control of color tone in coloring of stainless steel strip by providing a mechanism for the feedback control of electrolytic conditions permits the production of colored stainless steel strips having improved appearance without color shading. It will be, of course, understood that such a feedback control mechanism is not critical to the apparatus of the invention because the present apparatus can perform sufficient color control even without such a control mechanism.

The provision of a chromic acid regenerating tank 18 and a chromic acid waste disposal unit 19 as auxiliary equipment is preferred for the efficient maintenance of the continuous line.

The operation of the apparatus for continuously producing a colored stainless steel stock according to the present invention will now be described.

A stainless steel strip 1 is unwound from the uncoiler 2, passed through the degreasing tank 3 (alkaline bath) where contaminants adhered to the surface such as oil are removed, rinsed in the hot water rinse tank 4, passed into the pickling tank 5 (nitric acid bath, for example) where a uniform passive film forms on the surface, rinsed in the hot water rinse tank 6, and then admitted into the alternating current electrolytic tank 8 through the conductor roll 7. Alternating current electrolysis is effected between the counter electrode 9 disposed in the tank and the stainless steel strip 1, and the strip which has undergone a coloring treatment exits from the alternating current electrolytic tank 8.

In the practice of the present invention, the color discriminating sensor 11 is located above the guide roll 10 at the exit of the tank, the solution on the stainless steel strip 1 may be blown off with pressurized air at a site where color tone measurement is performed, and the resulting data of color tone measurement (color may be represented using color difference according to JIS Z 8730) are supplied at any time to the control computer 12. When an input is in excess of the threshold of color difference preset in the computer 12, a command signal instructing to optimize electrolytic conditions (current densities i and times t for anodic electrolysis and cathodic electrolysis, electrolysis frequency N, solution concentration, bath temperature and the like) is delivered, and such commands are executed. At this point, it is unnecessary to change the web transfer speed.

Such a feedback control allows for a more precise color control, resulting in an increased yield of products.

INDUSTRIAL APPLICABILITY

According to the first embodiment of the present invention, since a colored stainless steel stock is produced by using a coloring electrolyte solution containing ions comprising a metal having a plurality of valence numbers such as hexavalent chromium, permanganate salt, hexavalent molybdenum, pentavalent vanadium, etc. and conducting alternating current electrolysis under appropriate conditions for the electrolyte solution used, any desired color among a variety of colors may be obtained in a uniform tone without color shading and the resulting film has improved abrasion resistance. This embodiment accomplishes coloring and film hardening treatments in a single solution by a single step, that is, requires only one tank as opposed to the prior art dual solution/dual step process, obviating the loss of aesthetic appearance caused by color shading which would otherwise occur during film hardening or other steps. The single solution/single step treatment allows colored stainless steel stock with a constant color tone to be continuously produced in a stable fashion by an easier method than the prior art method, providing a stable, large scale commercial supply of stainless steel products with a variety of color tones and improved corrosion resistance at a low cost.

When a stainless steel stock is used as the counter electrode, two or more steel stocks can be colored at the same time, increasing operation efficiency at least two folds or producing two-fold colored steel stocks with the same quantity of electricity.

The second embodiment ensures the production of colored stainless steel stock with less color shading because a predetermined pre-treatment step is employed.

The third embodiment permits colored stainless steel stock to be continuously produced with a constant color tone because the color tone developed at the end of the coloring treatment is measured to control coloring electrolytic treatment conditions.

The fourth embodiment ensures the production of colored stainless steel stock with less color shading and a more constant color tone because a predetermined pretreatment step is employed, an alternating current electrolytic treatment is thereafter effected, and the color tone developed at the end of the coloring treatment is measured to control coloring electrolytic treatment conditions.

Since a stainless steel stock is subjected to coloring treatment by dipping it in a predetermined coloring solution of hexavalent chromium, permanganate salt, hexavalent molybdenum, pentavalent vanadium, etc., and then to electrolysis in the same solution, the fifth embodiment of the present invention requires only one tank as opposed to the prior art dual solution/dual step process, providing a supply of colored stainless steel stock having a homogeneous hard film of quality at low cost while obviating the loss of aesthetic appearance caused by color shading which would otherwise occur during film hardening or other steps and the problem of installation investment.

The sixth embodiment ensures the production of colored stainless steel stock with less color shading and having a more homogeneous uniform film of quality at low cost with a less expensive installation because a predetermined pretreatment step is employed, a coloring treatment by dipping in a predetermined coloring solution is thereafter effected, and electrolysis is then effected in the same solution.

The seventh embodiment is directed to an apparatus for continuously coloring stainless steel stock comprising in series arrangement, pre-treating means, alternating current electrolysis coloring means capable of effecting coloring and film hardening treatments by a single solution/single step process, and post-treatment means, and allows colored stainless steel stocks with a variety of color tones to be continuously produced in an easier and more stable fashion in a larger amount than in the prior art method, presenting a supply of inexpensive products.

The eighth embodiment ensures the stable and low cost production of colored stainless steel stocks with a variety of color tones to a constant color tone in a convenient way without the need for skill because pretreating means, alternating current electrolysis coloring means, and post-treatment means are serially arranged, and color discriminating means associated with predetermined control means is located at the colored steel stock exit side of the alternating current electrolysis coloring means whereby the coloring electrolytic conditions can be controlled in response to the measurement of color tone.

The colored stainless steel stocks produced by the method and apparatus of the present invention are thus useful in a wide range of applications including ships, vehicles, aircrafts, automobiles, buildings, and the like as inexpensive colored stainless steel stocks having a variety of color tones with a constant color tone.

BEST MODES FOR CARRYING OUT THE INVENTION

The present invention will be further detailed by presenting examples thereof below along with comparative examples.

EXAMPLE 1

[Present method]

Stainless steel plates in the form of SUS 304 BA (bright annealed) plates were colored by dipping them in solutions of various compositions, and carrying out alternating current electrolysis while changing electrolytic conditions.

[Comparative method]

Stainless steel plates were colored by the present method except that some parameters are outside.

[Prior art method]

Stainless steel plates were also colored by a prior art method involving dual solutions and dual steps rather than the alternating current electrolysis process.

The resulting plates were examined for color tone and abrasion resistance (Table 1).

The results are shown in Tables 1 to 7.

As seen from Tables 1 to 7, stainless steel plates are uniformly colored to a variety of color tones without color shading according to the present method. In particular, the colored stainless steel plates produced by the present method in Table 1 are also improved in abrasion resistance.

In Tables 1 and 7, the abrasion resistance was measured by an abrasion resistance test wherein a colored stainless steel plate is set in an abrasion tester under a load of 500 grams, and the surface of the colored film is rubbed with chromium oxide abrasive paper. The abrasion resistance is evaluated in terms of the number of rubs repeated with chromium oxide abrasive paper until the colored film is completely removed. The abrasion resistance is determined to be better with more rubs.

In Table 2 which shows the relationship of electrolysis frequency and color, there are tabulated the data obtained under similar conditions to those in Table 1 while the cathode electrolytic current is fixed to 0.10 $A/dm^2$and the anode electrolytic current density is varied to 0.03, 0.10, 0.50, and 2.0 $A/dm^2$ and the electrolysis frequency varied in the range of less than 100 Hz.

As seen from the data of this table, a film having any desired interference color is obtained simply by selecting the electrolysis frequency under certain electrolytic conditions. That is, the present method provides a novel color tone adjustment completely different from prior art methods.

Table 5 contains measurements of color difference on the respective specimens in Table 4. Measurement is made by measuring the color of a colored stainless steel plate at four points spaced 2 and 5 cm from the edge on transverse lines of 7 cm long spaced 2 cm from the top and bottom of the plate by means of a color difference photometer (Minolta, CR100) according to CIE 1976 (L*a*b*) standard colorimetric system, selecting one of the four measuring points in each plate plane as a reference (designated by suffix 1), and determining the color difference of the remaining three points (designated by suffixes 2, 3, and 4) from the reference:

$$(\Delta E)ab(\Delta E^*ab=[(\Delta L^*)^2+(\Delta a^*)^2+(\Delta b^*)^2]^{178}.$$

As seen from Table 5, the color difference observed on the products according to the present methods is within 0.3 whereas the products according to the comparative and prior art methods displayed a color difference of 3 or more.

According to the National Bureau of Standards, Department of Commerce of the U.S., the NBS color difference expressed in ($0.92\times\Delta E^*ab$) is classified as follows.

| | |
|---|---|
| 0.5 or less | trace |
| 0.5–1.5 | slight |
| 1.5–3.0 | noticeable |
| 3.0–6.0 | appreciable |

When judged according to this judgment standard, the products of the comparative and prior art methods display a color difference of "noticeable" to "appreciable" level which leads to color shading to visual observation whereas the products of the present method display a color difference of the order of trace level which is uniform to visual observation, producing no perceivable color shading.

TABLE 1

| | Solution composition | Electrolytic conditions: Anodic C.D. ($A/dm^2$) | Cathodic C.D. ($A/dm^2$) | Frequency (Hz) | Rubs | Abrasion resistance | Color |
|---|---|---|---|---|---|---|---|
| Present method | hexavalent chromium 2.5 mol/l + Sulfuric acid 5.0 mol/l | 0.15 | 0.08 | 40 | 650 | Exc | blue |
| | | 2.5 | 4.2 | 1 | 720 | Exc | gold |
| | | 0.03 | 0.50 | 0.1 | 680 | Exc | purple |
| | hexavalent chromium 0.7 mol/l + Sulfuric acid 1.2 mol/l | 0.08 | 0.10 | 0.05 | 610 | Exc | pale brown |
| | | 0.15 | 0.15 | 0.10 | 670 | Exc | brown |
| | | 0.21 | 0.18 | 0.10 | 700 | Exc | pale blue |
| Comparative method | hexavalent chromium 2.5 mol/l + Sulfuric acid 5.0 mol/l | 0.50 | 1.2 | 400 | 200 | Poor | pale brown |
| | | 0.35 | 0.02 | 20 | 80 | Poor | gold |
| | | 4.0 | 0.90 | 50 | 120 | Poor | green (color shading) |

| | Coloring treatment: Solution composition | Condition | Hardening treatment: Solution composition | Condition | Rubs | Abrasion resistance | Color |
|---|---|---|---|---|---|---|---|
| Prior art method | hexavalent chromium 2.5 mol/l + sulfuric acid 5.0 mol/l | Simple dip | hexavalent chromium 2.5 mol/l + sulfuric acid 0.03 mol/l | 4.8 $A/dm^2$ × 7 min. | 240 | Ord. | blue |
| | | Simple dip 0.1 $A/dm^2$ × 5 min. | | 4.8 $A/dm^2$ × 7 min. | 280 | Ord. | gold |
| | | 0.3 $A/dm^2$ × 7 min. | | 4.8 $A/dm^2$ × 7 min. | 300 | Ord. | blue |
| | | | | 4.8 $A/dm^2$ × 7 min. | 320 | Ord. | purple |

Underlines indicate outside the scope of the present invention.

TABLE 2

| Anodic current | 0.03 $A/dm^2$ | | | | | |
|---|---|---|---|---|---|---|
| Frequency (Hz) | 1 | 4 | 7 | 10 | 18 | 25 |
| Color | purple | green | red | gold | blue | black |
| Anodic current | 0.1 $A/dm^2$ | | | | | |
| Frequency (Hz) | 2 | 8 | 20 | 35 | 60 | 75 |
| Color | purple | green | red | gold | blue | black |

TABLE 2-continued

| Anodic current | 0.5 $A/dm^2$ | | | | | |
|---|---|---|---|---|---|---|
| Frequency (Hz) | 5 | 12 | 25 | 45 | 70 | 95 |
| Color | purple | green | red | gold | blue | black |
| Anodic current | 2.0 $A/dm^2$ | | | | | |
| Frequency (Hz) | 12 | 26 | 38 | 57 | 82 | 98 |
| Color | purple | green | red | gold | blue | black |

TABLE 3

| | Solution composition | Electrolytic conditions: Anodic C.D. ($A/dm^2$) | Cathodic C.D. ($A/dm^2$) | Frequency (Hz) | Time (min.) | Color |
|---|---|---|---|---|---|---|
| Present method | 40% sulfuric acid aqueous solution + potassium permanganate 2 wt % Temp 60° C. | 0.01 | 0.01 | 0.05 | 20 | gold |
| | | 0.02 | 0.02 | 0.1 | 20 | bronze |
| | | 0.05 | 0.05 | 0.1 | 15 | brown |
| | | 0.1 | 0.1 | 0.1 | 10 | blackish brown |
| | | 0.04 | 0.04 | 5 | 20 | bronze |
| | | 0.08 | 0.08 | 8 | 20 | brown |
| Comparative method | | 0.2 | 0.2 | 5 | 20 | gold/bronze (speckled) |
| | | 0.05 | 0.2 | 3 | 15 | uncolored |
| | | 0.08 | 0.08 | 20 | 15 | pale brown (color shading) |

| | Coloring treatment: Solution composition | condition | Hardening treatment: Solution composition | condition | Coloring time (min.) | Color |
|---|---|---|---|---|---|---|
| Prior art method | 40% sulfuric acid | Simple dip | chromic acid 250 g/l | 0.2 $A/dm^2$ × | 20 | Brown |

TABLE 3-continued

| | | | | | |
|---|---|---|---|---|---|
| | aqueous solution + potassium permanganate 2 wt % Temp 100° C. | Simple dip | + phosphoric acid 2.5 g/l | 10 min. 0.2 A/dm² × 10 min. | 20 | Bronze |

Underlines indicate outside the scope of the present invention.

TABLE 4

| | Solution composition | Electrolytic conditions: Anodic C.D. (A/dm²) | Cathodic C.D. (A/dm²) | Frequency (Hz) | Time (min.) | Color | Specimen designation |
|---|---|---|---|---|---|---|---|
| Present method | NaOH 40 wt % | 0.01 | 0.01 | 0.05 | 20 | brown | A1 |
| | $KMnO_4$ 5 wt % | 0.03 | 0.03 | 0.05 | 20 | bronze | A2 |
| | in water | 0.08 | 0.08 | 0.1 | 20 | deep bronze | A3 |
| | Temp. 60° C. | 0.1 | 0.1 | 0.1 | 20 | brown | A4 |
| | NaOH 40 wt % | 0.01 | 0.03 | 0.05 | 25 | brown | A5 |
| | $KMnO_4$ 3 wt % | 0.03 | 0.08 | 0.05 | 25 | bronze | A6 |
| | $MnO_2$ 5 wt % | 0.08 | 0.08 | 0.1 | 25 | deep bronze | A7 |
| | in water | | | | | | |
| | Temp. 60° C. | 0.1 | 0.1 | 0.1 | 25 | brown | A8 |
| Comparative method | NaOH 40 wt % | 0.8 | 0.8 | 10 | 20 | gold (speckled) | C1 |
| | $KMnO_4$ 5 wt % | 0.06 | 1.0 | 50 | 20 | uncolored | C2 |
| | in water | 0.1 | 0.1 | 400 | 20 | uncolored | C3 |
| | Temp. 60° C. | | | | | | |
| | NaOH 40 wt % | 0.7 | 0.7 | 5 | 20 | bronze (speckled) | C4 |
| | $KMnO_4$ 3 wt % | 0.1 | 0.8 | 40 | 20 | uncolored | C5 |
| | $MnO_2$ 5 wt % | | | | | | |
| | Temp. 60° C. | 0.08 | 0.08 | 400 | 20 | uncolored | C6 |

| | Coloring treatment: Solution composition | Condition | Coloring treatment time (min.) | Color | Specimen designation |
|---|---|---|---|---|---|
| Prior art method | NaOH 40 wt % $KMnO_4$ 5 wt % in water Temp. 100° C. | Simple dipping | 15 | pale brown | B1 |
| | NaOH 40 wt % $KMnO_4$ 3 wt % $MnO_2$ 5 wt % in water Temp. 100° C. | Simple dipping | 25 | brown | B2 |
| | | Simple dipping | 17 | pale brown | B3 |
| | | Simple dipping | 30 | brown | B4 |

Underlines indicate outside the scope of the present invention.

TABLE 5

| | Specimen No. | Color | Color difference 1 | 2 | 3 | 4 |
|---|---|---|---|---|---|---|
| Present method | A1 | brown | 0 | 0.23 | 0.02 | 0.15 |
| | A2 | bronze | 0 | 0.03 | 0.12 | 0.20 |
| | A3 | deep bronze | 0 | 0.15 | 0.10 | 0.05 |
| | A4 | brown | 0 | 0.30 | 0.25 | 0.16 |
| | A5 | brown | 0 | 0.10 | 0.18 | 0.07 |
| | A6 | bronze | 0 | 0.23 | 0.21 | 0.09 |
| | A7 | deep bronze | 0 | 0.03 | 0.09 | 0.05 |
| | A8 | brown | 0 | 0.09 | 0.17 | 0.11 |
| Compar- | C1 | gold (speckled) | 0 | 10.2 | 5.85 | 3.75 |

TABLE 5-continued

| | Specimen No. | Color | Color difference 1 | 2 | 3 | 4 |
|---|---|---|---|---|---|---|
| ative method | C2 | uncolored | | not measured | | |
| | C3 | uncolored | | not measured | | |
| | C4 | bronze (speckled) | 0 | 3.21 | 6.75 | 4.61 |
| | C5 | uncolored | | not measured | | |
| | C6 | uncolored | | not measured | | |
| Prior art method | B1 | pale brown | 0 | 2.56 | 2.96 | 3.84 |
| | B2 | brown | 0 | 1.56 | 0.53 | 3.71 |
| | B3 | pale brown | 0 | 0.78 | 3.51 | 2.05 |
| | B4 | brown | 0 | 2.76 | 4.71 | 0.51 |

TABLE 6

| | Solution composition | Electrolytic conditions: Anodic C.D. (A/dm²) | Cathodic C.D. (A/dm²) | Frequency (Hz) | Time (min.) | Color |
|---|---|---|---|---|---|---|
| Present method | $Na_3VO_4$ 1.0 mol/l + sulfuric acid 7 mol/l | 0.02 | 0.02 | 0.05 | 15 | gold |
| | | 0.05 | 0.05 | 0.1 | 10 | bronze |
| | Temp. 60° C. | 0.2 | 0.2 | 1.0 | 12 | faint black |
| Prior art method | $Na_3VO_4$ 1.0 mol/l + sulfuric acid 7 mol/l | dipping method* | | | 20 | gold |

TABLE 6-continued

| Solution composition | Electrolytic conditions: Anodic C.D. ($A/dm^2$) | Cathodic C.D. ($A/dm^2$) | Frequency (Hz) | Time (min.) | Color |
|---|---|---|---|---|---|
| Temp. 85° C. | dipping method* | | | 13 | bronze |

*Dipping according to the method described by Endo et al. in Japanese Patent Application Kokai No. 53-16328 (Japanese Patent Publication No. 59-26668) in the name of Rasa Industry K.K.

TABLE 7

| | Solution composition | Electrolytic conditions: Anodic C.D. ($A/dm^2$) | Cathodic C.D. ($A/dm^2$) | Frequency (Hz) | Rubs | Abrasion resistance | Color |
|---|---|---|---|---|---|---|---|
| Present method | $Na_2MoO_4$ 1 mol/l + sulfuric acid 3 mol/l + hexavalent chromium 0.8 mol/l Temp. 60° C. | 0.07 | 0.10 | 0.04 | 670 | Exc | bronze |
| | | 0.12 | 0.12 | 0.1 | 640 | Exc | gold |
| | | 0.21 | 0.21 | 2.0 | 610 | Exc | faint gold |
| Other method | $Na_2MoO_4$ 1 mol/l + sulfuric acid 3 mol/l + hexavalent chromium 0.8 mol/l Temp. 80° C. | dipping method* (dipped in solution for 15 min.) | | | 280 | Poor | blue |

*The dipping method used is an unknown method.

EXAMPLE 2

A pair of opposed SUS 304 BA plates (bright annealed) were dipped in a solution of different composition and subjected to alternating current electrolysis under different electrolytic conditions, thus coloring the pair of stainless steel plates at the same time.

These specimens according to the present invention and specimens obtained by coloring stainless steel plates in the same dipping solution under the same electrolytic conditions using Pt as the counter electrode were examined for color tone, color difference, and abrasion resistance. The results are shown in Table 8.

The color difference was measured using a color meter manufactured by Suga Tester K.K. and the abrasion resistance was measured by attaching chromium oxide abrasive paper in an abrasion tester type ISO-1 manufactured by Suga Tester K.K., applying a load of 500 gram-f, and counting rubs until the stainless steel matrix was fully exposed on the surface.

The color difference was measured at one point in a central portion of 10 cm by 10 cm per specimen according to the recommended procedure of CIE (Commission Internationale de l'Eclairage), 1976. Three pieces were photometrically measured under the same conditions and randomly placed in the order of ①, ②, and ③, ① (counter electrode of platinum) was selected as a reference, and the color differences between ① and ② and between ① and ③ were determined, which are shown in Table 8 along counted rubs counted rubs.

The color difference from the counter electrode fell within 0.5 and was thus unperceivable. The abrasion resistance was good because the counted rubs did not depend on the counter electrode.

TABLE 8

| Solution composition | Electrolytic conditions: Anodic C.D. ($A/dm^2$) | Cathodic C.D. ($A/dm^2$) | Frequency (Hz) | Time (min.) | Counter electrode | Color | Color difference from 1 | Rubs |
|---|---|---|---|---|---|---|---|---|
| sulfuric acid 490 g/l chromic anhydride 250 g/l Temp. 60° C. | 0.15 | 0.08 | 40 | 20 | ① | blue | — | 650 |
| | | | | | ② | blue | 0.1 | 600 |
| | | | | | ③ | blue | 0.1 | 620 |
| | 2.5 | 4.2 | 1 | 20 | ① | gold | — | 720 |
| | | | | | ② | gold | 0.2 | 700 |
| | | | | | ③ | gold | 0.4 | 720 |
| | 0.03 | 0.50 | 0.1 | 20 | ① | purple | — | 680 |
| | | | | | ② | purple | 0.4 | 680 |
| | | | | | ③ | purple | 0.5 | 660 |
| phosphoric acid 490 g/l chromic anhydride 250 g/l Temp. 60° C. phosphoric acid | 0.12 | 0.12 | 0.05 | 20 | ① | gold | — | 610 |
| | | | | | ② | gold | 0.1 | 600 |
| | | | | | ③ | gold | 0.1 | 650 |

TABLE 8-continued

| Solution composition | Electrolytic conditions: Anodic C.D. (A/dm²) | Cathodic C.D. (A/dm²) | Frequency (Hz) | Time (min.) | Counter electrode | Color | Color difference from 1 | Rubs |
|---|---|---|---|---|---|---|---|---|
| 10 g/l sulfuric acid 450 g/l chromic anhydride 450 g/l Temp. 60° C. | 0.23 | 0.25 | 0.2 | 20 | ① | blue | — | 650 |
| | | | | | ② | blue | 0.3 | 670 |
| | | | | | ③ | blue | 0.4 | 680 |

①: Platinum is used as counter electrode.
②, ③: Two steel strips are opposed.

EXAMPLE 3

Using SUS 304 BA plates (bright annealed), a pre-treatment was carried out in two ways by the present method and by a prior art dipping method. Thereafter, the plates were subjected to a coloring treatment to develop a blue color by the alternating current electrolysis method and the dipping method. The color difference was determined by selecting one point at the center of the same plate surface as a reference, measuring color difference at five points including the selected point and the four corners of a rectangular surrounding the selected point. The conditions for the treatments are detailed below.

Pre-treatment according to the present method

The solution used was a solution containing 15% nitric acid plus 0.5% phosphoric acid at 40° C. A specimen plate having a surface area of 100 cm² was subjected to a cathodic treatment at 1.0 A/dm²2 for 1 minute and an anodic treatment at 0.01 A/dm²for 1 minute using a galvanostat.

Pre-treatment by dipping according to the prior art

A plate was dipped in a 15% nitric acid solution at 40° C. for 1 minute.

Alternating current electrolysis conditions

Anodic and cathodic current densities were 0.25 A/dm², anodic and cathodic electrolysis times were 18 seconds, electrolysis frequency was 35 cycles. The solution used was a solution containing 450 g/liter of sulfuric acid plus 230 g/liter of chromic anhydride at 60° C.

In the prior art method, a blue color was developed by dipping at 80° C. for 5 to 7 minutes in the solution of the same composition as used in the alternating current electrolysis method.

Color difference measurement was based on (L*a*b*) standard colorimetric system by the recommended procedure of CIE (Commission Internationale de l'Eclairage), 1976, using a color difference photometer (Minolta, CR100), and the color difference: ΔE*ab was calculated.

To prevent the introduction of a personal error by visual observation in the determination of color shading, the color is herein determined as being shaded when the NBS unit (0.92×ΔE*ab) exceeds 1.0 (that is, ΔE*ab≧1.09), provided that the NBS unit in the range of 0.5 to 1.5 representing the slight level is a standard. Visual observation affords little discrimination around this determination standard.

The thus obtained results are shown in Table 9. A1 to A4 correspond to the present method and B1 to B4 correspond to the prior art method. The color difference is determined by assuming five points (the center and the four corners of a rectangular surrounding the center) on the surface of a plate of 10 cm by 10 cm, selecting the center as a reference having a color difference of 1, and determining the color difference of the remaining four points from the center.

As seen from the data, chemically colored stainless steel plates without substantial color shading can be obtained by carrying out the pre-treatment according to the present method.

TABLE 9

| | Specimen No. | Color difference 1 | 2 | 3 | 4 | 5 | Judgment (color shading X no color shading O) | Coloring process |
|---|---|---|---|---|---|---|---|---|
| Present method | A1 | 0 | 0.05 | 0.18 | 0.10 | 0.14 | O | alternating current electrolysis |
| | A2 | 0 | 0.09 | 0.12 | 0.25 | 0.13 | O | |
| | A3 | 0 | 0.31 | 0.13 | 0.21 | 0.21 | O | |
| | A4 | 0 | 0.15 | 0.35 | 0.36 | 0.23 | O | |
| Prior art method | B1 | 0 | 1.83 | 0.51 | 2.51 | 0.99 | X | dipping |
| | B2 | 0 | 2.11 | 1.51 | 1.10 | 0.65 | X | |
| | B3 | 0 | 0.36 | 1.25 | 0.83 | 1.10 | X | |
| | B4 | 0 | 1.51 | 0.56 | 1.38 | 1.21 | X | |

EXAMPLE 4

In carrying out alternating current electrolysis using the apparatus shown in FIG. 1, a solution having a composition of 250 g/liter of chromic anhydride plus 500 g/liter of sulfuric acid at a temperature of 60° C.+2° C. was used in the alternating current electrolytic tank. SUS 304 BA (bright annealed) steel strips were subjected to a coloring treatment at anodic and cathodic current densities of 0.5 A/dm², anodic and cathodic electrolysis times of 3 sec. and a strip transfer speed of 10 cm/min. The electrode was 100 cm long.

The coloring of the strip was detected at any time by a color discriminating sensor (Minolta, type CA-100), and the detected signals were supplied to a control computer (TEAC, type PS-8000). The computer was programmed to perform information analysis so as to produce a command signal to make a correction to meet the above-mentioned optimum conditions when the predetermined range, that is, the NBS unit ($0.92 \times \Delta E^*ab$) of 1.0, is exceeded, and it was operated to execute the task.

It is to be noted that $\Delta E^*ab$ was calculated on the basis of the ($L^*a^*b^*$) standard colorimetric system by the recommended procedure of CIE (Commission Internationale de l'Eclairage), 1976, using a color difference photometer (Minolta, CA-100).

A comparative run was made by dipping at 80° C., or coloring at a different strip transfer speed. The solution had the same composition and the strip transfer speed was varied in the range of 5 to 10 cm/min.

A blue color was developed on the stainless steel strips under these conditions. Color difference measurement according to JIS Z 8730 was made on the colored stainless steel strips obtained by both the methods at nine points spaced 10 cm transverse the strip of 1 m wide.

It was found that the present example displayed a color difference $\Delta E$ within 0.2 whereas the comparative example displayed a color difference $\Delta E$ of about 3.5.

The present example was visually observed to find no difference in color, indicating a very high degree of uniformity of color development. The comparative example appeared blue approximately throughout the surface, but left perceivable color shading particularly at edges. In the comparative example, a film hardening treatment was then effected, during which the color tone changed.

EXAMPLE 5

SUS 304 BA (bright annealed) steel strips were dipped in various coloring solutions to color the strips, and then a film hardening treatment was accomplished by conducting cathodic electrolysis in the same solution under varying electrolytic conditions.

A prior art method used a coloring solution and a film hardening solution which were different in composition, and a film hardening treatment was accomplished by conducting cathodic electrolysis under different electrolytic conditions.

The resulting specimens were examined for color tone, occurrence of color shading, and abrasion resistance. The results are shown in Tables 10 to 15.

To prevent the introduction of a personal error by visual observation in the determination of color shading, the color is herein determined as being shaded when the NBS unit ($0.92 \times \Delta E^*ab$) exceeds 1.0 (that is, $\Delta E^*ab \geqq 1.09$), provided that the NBS unit in the range of 0.5 to 1.5 representing the slight level is a standard.

The abrasion resistance was measured by attaching chromium oxide abrasive paper in an abrasion tester type ISO-1 manufactured by Suga Tester K.K., applying a load of 500 gram-f, and counting rubs until the stainless steel was fully exposed on the surface.

As seen from the results shown in Tables 10 to 15, the present method allows a wide variety of color tones to be uniformly developed without color shading while affording improved abrasion resistance.

TABLE 10

| | Solution composition | | Temp. | Coloring time | Cathodic electrolysis | | | | |
|---|---|---|---|---|---|---|---|---|---|
| | $CrO_3$ (g/l) | $H_2SO_4$ (g/l) | (°C.) | (min.) | C.D. ($A/dm^2$) | Time (min.) | Color | Color shading | Rubs |
| Present method | 250 | 490 | 60 | 20 | 0.05 | 10 | blue | no | 380 |
| | 250 | 490 | 60 | 20 | 0.1 | 5 | blue | no | 390 |
| | 200 | 500 | 40 | 30 | 0.2 | 3 | gold | no | 350 |
| | 500 | 700 | 40 | 10 | 0.1 | 5 | gold | no | 340 |
| | 200 | 250 | 30 | 40 | 0.5 | 3 | brown | no | 400 |
| | 300 | 500 | 70 | 12 | 0.1 | 5 | green | no | 410 |
| Comparative method | 250 | 490 | 60 | 20 | 1 | 1 | blue | yes | 250 |
| | 250 | 490 | 60 | 20 | 1 | 3 | blue | yes | 230 |
| | 250 | 200 | 60 | 70 | 0.1 | 5 | brown | yes | 300 |
| | 300 | 500 | 80 | 15 | 2 | 3 | gold | yes | 200 |
| | 300 | 500 | 80 | 15 | 1.5 | 1 | gold | yes | 220 |

| | Coloring solution composition | Coloring time (min.) | Hardening solution composition | | Temp. | Cathodic electrolysis | | | | |
|---|---|---|---|---|---|---|---|---|---|---|
| | | | $CrO_3$ (g/l) | $H_2SO_4$ (g/l) | (°C.) | C.D. ($A/dm^2$) | Time (min.) | Color | Color Shading | Rubs |
| Prior art method | $CrO_3$ | 7 | 250 | 2.5 | 40 | 4.8 | 7 | blue | no | 350 |
| | 250 g/l | 7 | 250 | 2.5 | 60 | 4.8 | 7 | blue | no | 360 |
| | $H_2SO_4$ | | | | | | | | | |
| | 490 g/l | 10 | 300 | 1 | 40 | 2.4 | 7 | gold | yes | 300 |
| | Temp. 80° C. | 10 | 300 | 1 | 40 | 4.8 | 4 | gold | no | 320 |
| | | 10 | 300 | 1 | 40 | 7.2 | 4 | gold | yes | 300 |

TABLE 11

| | Solution composition | | | Coloring | Cathodic electrolysis | | | | |
|---|---|---|---|---|---|---|---|---|---|
| | $KMnO_4$ (wt %) | $H_2SO_4$ (wt %) | Temp. (°C.) | time (min.) | C.D. ($A/dm^2$) | Time (min.) | Color | Color shading | Rubs |
| Present method | 2 | 40 | 100 | 20 | 0.08 | 10 | bronze | no | 370 |
| | 2 | 40 | 100 | 20 | 0.05 | 12 | blackish brown | no | 320 |
| | 7 | 50 | 100 | 20 | 0.08 | 10 | bronze | no | 380 |
| | 7 | 50 | 100 | 25 | 0.03 | 10 | bronze | no | 370 |
| Comparative method | 2 | 40 | 100 | 25 | 0.8 | 15 | milky white | yes | 260 |
| | 2 | 40 | 100 | 20 | 0.3 | 10 | pale brown | yes | 390 |
| | 7 | 50 | 100 | 25 | 0.8 | 15 | milky white | yes | 410 |

TABLE 11-continued

| | Solution composition | | | Coloring | Cathodic electrolysis | | | | |
|---|---|---|---|---|---|---|---|---|---|
| | $KMnO_4$ (wt %) | $H_2SO_4$ (wt %) | Temp. (°C.) | time (min.) | C.D. ($A/dm^2$) | Time (min.) | Color | Color shading | Rubs |
| | 7 | 50 | 100 | 20 | 0.3 | 10 | pale brown | yes | 370 |
| Prior art | 2 | 40 | 100 | 20 | | | brown | no | 120 |
| method | 2 | 40 | 100 | 25 | | | bronze | no | 140 |
| | 7 | 50 | 100 | 15 | dipping | | brown | no | 120 |
| | 7 | 50 | 100 | 20 | | | bronze | no | 130 |

TABLE 12

| | Solution composition | | | Coloring | Cathodic electrolysis | | | | |
|---|---|---|---|---|---|---|---|---|---|
| | $KMnO_4$ (wt %) | NaOH (wt %) | Temp. (°C.) | time (min.) | C.D. ($A/dm^2$) | Time (min.) | Color | Color shading | Rubs |
| Present | 5 | 40 | 100 | 20 | 0.4 | 10 | brown | no | 260 |
| method | 5 | 40 | 100 | 25 | 0.2 | 10 | bronze | no | 210 |
| | 7 | 35 | 100 | 20 | 0.4 | 10 | brown | no | 280 |
| | 7 | 35 | 100 | 25 | 0.2 | 10 | bronze | no | 250 |
| Comparative | 5 | 40 | 100 | 20 | 1.0 | 10 | milky white | yes | 310 |
| method | 5 | 40 | 100 | 25 | 0.7 | 10 | brown | yes | 280 |
| | 7 | 35 | 100 | 20 | 1.0 | 10 | milky white | yes | 340 |
| | 7 | 35 | 100 | 25 | 0.7 | 10 | brown | yes | 270 |
| Prior art | 5 | 40 | 100 | 15 | | | brown | no | 90 |
| method | 5 | 40 | 100 | 25 | | | bronze | no | 120 |
| | 7 | 35 | 100 | 15 | dipping | | brown | no | 130 |
| | 7 | 35 | 100 | 20 | | | bronze | no | 160 |

TABLE 13

| | Solution composition | | | | Coloring | Cathodic electrolysis | | | | |
|---|---|---|---|---|---|---|---|---|---|---|
| | $KMnO_4$ (wt %) | $MnO_2$ (wt %) | NaOH (wt %) | Temp. (°C.) | time (min.) | C.D. ($A/dm^2$) | Time (min.) | Color | Color shading | Rubs |
| Present | 3 | 3 | 40 | 100 | 20 | 0.4 | 10 | brown | no | 340 |
| method | 3 | 3 | 40 | 100 | 25 | 0.2 | 10 | bronze | no | 280 |
| | 5 | 2 | 40 | 100 | 20 | 0.4 | 10 | brown | no | 350 |
| | 5 | 2 | 40 | 100 | 25 | 0.2 | 10 | bronze | no | 310 |
| Comparative | 3 | 3 | 40 | 100 | 20 | 1.2 | 10 | milky white | yes | 430 |
| method | 3 | 3 | 40 | 100 | 25 | 0.7 | 10 | pale brown | yes | 390 |
| | 5 | 2 | 40 | 100 | 20 | 1.2 | 10 | milky white | yes | 400 |
| | 5 | 2 | 40 | 100 | 25 | 0.7 | 10 | pale brown | yes | 380 |
| Prior art | 3 | 3 | 40 | 100 | 17 | | | brown | no | 120 |
| method | 3 | 3 | 40 | 100 | 20 | | | bronze | no | 170 |
| | 5 | 2 | 40 | 100 | 17 | dipping | | brown | no | 130 |
| | 5 | 2 | 40 | 100 | 20 | | | bronze | no | 160 |

TABLE 14

| | Solution composition | | | Coloring | Cathodic electrolysis | | | | |
|---|---|---|---|---|---|---|---|---|---|
| | $Na_3VO_4$ (mol/l) | $H_2SO_4$ (mol/l) | Temp. (°C.) | time (min.) | C.D. ($A/dm^2$) | Time (min.) | Color | Color shading | Rubs |
| Present | 1.0 | 7.0 | 100 | 15 | 0.4 | 10 | bronze | no | 410 |
| method | 1.0 | 7.0 | 100 | 20 | 0.2 | 10 | gold | no | 370 |
| | 0.7 | 5.0 | 100 | 15 | 0.4 | 10 | faint black | no | 330 |
| | 0.7 | 5.0 | 100 | 20 | 0.2 | 10 | bronze | no | 300 |
| Prior art | 1.0 | 7.0 | 100 | 15 | | | bronze | no | 130 |
| method | 1.0 | 7.0 | 100 | 20 | | | gold | no | 110 |
| | 0.7 | 5.0 | 100 | 15 | dipping | | faint black | no | 90 |
| | 0.7 | 5.0 | 100 | 20 | | | bronze | no | 120 |

TABLE 15

| | Solution composition | | | | Coloring | Cathodic electrolysis | | | | |
|---|---|---|---|---|---|---|---|---|---|---|
| | $NaMoO_4$ (mol/l) | $CrO_3$ (mol/l) | $H_2SO_4$ (mol/l) | Temp. (°C.) | time (min.) | C.D. ($A/dm^2$) | Time (min.) | Color | Color shading | Rubs |
| Present | 1.0 | 0.8 | 3.0 | 80 | 15 | 0.2 | 15 | blue | no | 450 |
| method | 1.0 | 0.8 | 3.0 | 80 | 20 | 0.4 | 15 | gold | no | 410 |
| | 0.7 | 2.0 | 4.5 | 80 | 10 | 0.2 | 10 | blue | no | 470 |
| | 0.7 | 2.0 | 4.5 | 80 | 15 | 0.4 | 10 | gold | no | 430 |
| Other process | 1.0 | 0.8 | 3.0 | 80 | 15 | | | blue | no | 280 |
| (unknown to | 1.0 | 0.8 | 3.0 | 80 | 20 | | | gold | no | 310 |

TABLE 15-continued

| | Solution composition | | | | Coloring | Cathodic electrolysis | | | | |
|---|---|---|---|---|---|---|---|---|---|---|
| | $NaMoO_4$ (mol/l) | $CrO_3$ (mol/l) | $H_2SO_4$ (mol/l) | Temp. (°C.) | time (min.) | C.D. ($A/dm^2$) | Time (min.) | Color | Color shading | Rubs |
| the public) | 0.7 | 2.0 | 4.5 | 80 | 10 | dipping | | blue | no | 260 |
| | 0.7 | 2.0 | 4.5 | 80 | 15 | | | gold | no | 270 |

We claim:

1. A method for producing a colored stainless steel stock, characterized in that a stainless steel stock is subjected to alternating current electrolysis using an alternating current having a rectangular wave form in a coloring electrolyte solution containing ions comprising a metal having a plurality of valence numbers, thereby coloring the stock, said method further comprising the step of independently selecting the current density employed, the number of cycles of alternating current employed and electrolysis time employed during said electrolysis to achieve the desired coloring of the stainless steel stock.

2. A method for producing a colored stainless steel stock according to claim 1 wherein said coloring electrolyte solution is a mixed aqueous solution containing at least 0.5 mol/liter calculated as hexavalent chromium of a chromium compound and at least 1 mol/liter of sulfuric acid, and said alternating current electrolysis is conducted at an anodic current density of 0.01 to 3.0 $A/dm^2$, a cathodic current density of 0.03 to 5.0 $A/dm^2$, and a frequency of up to 100 Hz.

3. A method for producing a colored stainless steel stock according to claim 1 wherein said alternating current electrolysis is conducted in an alternating current electrolytic tank using a stainless steel stock as a counter electrode.

4. A method for producing a colored stainless steel stock, comprising subjecting a stainless steel stock which has been subjected to an electrolytic pickling treatment to alternating current electrolysis in a coloring electrolyte solution containing ions comprising a metal having a plurality of valence numbers, thereby coloring the stock, characterized in that said electrolytic pickling treatment is conducted in a solution containing 10 to 30% by weight of nitric acid and 0.5 to 5% by weight of phosphoric acid at 70° C. or lower, by a cathodic treatment at 0.5 to 2.0 $A/dm^2$, and a subsequent anodic treatment at 0.1 $A/dm^2$or less.

5. A method for producing a colored stainless steel stock according to claim 4 wherein said coloring electrolyte solution is a mixed aqueous solution containing at least 0.5 mol/liter calculated as hexavalent chromium of a chromium compound and at least 1 mol/liter of sulfuric acid, and said alternating current electrolysis is conducted at an anodic current density of 0.01 to 3.0 $A/dm^2$,a cathodic current density of 0.03 to 5.0 $A/dm^2$, and a frequency of up to 100 Hz.

6. A method for producing a colored stainless steel stock according to claim 4 wherein said coloring electrolyte solution is an aqueous solution of 30 to 75 wt % sulfuric acid to which 0.5 to 15 wt % calculated as $MnO_4$- of a permanganate salt is added for reaction, and said alternating current electrolysis is conducted at an anodic current density of 0.01 to 0.1 $A/dm^2$, a cathodic current density of 0.01 to 0.1 $A/dm^2$, and a frequency of up to 10 Hz.

7. A method for producing a colored stainless steel stock according to claim 4 wherein said coloring electrolyte solution is a mixed aqueous solution of 1 to 10 wt % of a permanganate salt and 30 to 50 wt % of an alkali metal or alkaline earth metal hydroxide, and said alternating current electrolysis is conducted at an anodic current density of 0.01 to 0.5 $A/dm^2$, a cathodic current density of 0.01 to 0.5 $A/dm^2$, and a frequency of up to 100 Hz.

8. A method for producing a colored stainless steel stock according to claim 4 wherein said coloring electrolyte solution is a mixed aqueous solution of 1 to 10 wt % of a permanganate salt, 30 to 50 wt % of an alkali metal or alkaline earth metal hydroxide, and 1 to 5 wt % of manganese dioxide, and said alternating current electrolysis is conducted at an anodic current density of 0.01 to 0.5 $A/dm^2$,. a cathodic current density of 0.01 to 0.5 $A/dm^2$, and a frequency of up to 100 Hz.

9. A method for producing a colored stainless steel stock according to claim 4 wherein said coloring electrolyte solution is a mixed aqueous solution containing 0.5 to 2 mol/liter calculated as hexavalent molybdenum of a molybdenum compound, 1 to 5 mol/liter of sulfuric acid, and 0.5 to 2 mol/liter calculated as hexavalent chromium of a chromium compound, and said alternating current electrolysis is conducted at an anodic current density of 0.01 to 0.5 $A/dm^2$, a cathodic current density of 0.01 to 0.5 $A/dm^2$, and a frequency of up to 10 Hz.

10. A method for producing a colored stainless steel stock according to claim 4 wherein said coloring electrolyte solution is a mixed aqueous solution containing 0.5 to 1.5 mol/liter calculated as pentavalent vanadium of a vanadium compound and 5 to 10 mol/liter of sulfuric acid, and said alternating current electrolysis is conducted at an anodic current density of 0.01 to 0.2 $A/dm^2$, a cathodic current density of 0.01 to 0.2 $A/dm^2$, and a frequency of up to 10 Hz.

11. A method for producing a colored stainless steel stock according to any one of claim 4 wherein said alternating current electrolysis is conducted in an alternating current electrolytic tank using a stainless steel stock as a counter electrode.

12. A method for producing a colored stainless steel stock, comprising subjecting a stainless steel stock to alternating current electrolysis using an alternating current having a rectangular wave form in a coloring electrolyte solution containing ions comprising a metal having a plurality of valence numbers, thereby coloring the stock, said method further comprising the steps of sensing the color difference achieved during said coloring step by means of a color discriminating sensor and changing the current density employed, the number of cycles of alternating current employed and electrolysis time employed during said electrolysis responsive to said sensed color difference to achieve the desired coloring of the stainless steel stock.

13. A method for producing a colored stainless steel stock according to claim 12 wherein said coloring electrolyte solution is a mixed aqueous solution containing at least 0.5 mol/liter calculated as hexavalent chromium of a chromium compound and at least 1 mol/liter of sulfuric acid, and said alternating current electrolysis is conducted at an anodic current density of 0.01 to 3.0 $A/dm^2$, a cathodic current density of 0.03 to 5.0 $A/dm^2$, and a frequency of up to 100 Hz.

14. A method for producing a colored stainless steel stock according to claim 12 wherein said alternating current electrolysis is conducted in the alternating current electrolytic tank using a stainless steel stock as a counter electrode.

15. A method for producing a colored stainless steel stock, comprising immersing in a tank a stainless steel stock which has been subjected to an electrolytic pickling treatment, subjecting the stock in the tank to alternating current electrolysis in a coloring electrolyte solution in the tank containing ions comprising a metal having a plurality of valence numbers, thereby coloring the stock, and removing the stock from the tank, characterized in that said electrolytic pickling treatment is conducted in a solution containing 10 to 30% by weight of nitric acid and 0.5 to 5% by weight of phosphoric acid at 70°C. or lower, by a cathodic treatment at 0.5 to 2.0 $A/dm^2$ and a subsequent anodic treatment at 0.1 $A/dm^2$or less, and a color difference is detected by a color discriminating sensor that detects the color of the stock upon said removing of the stock from the tank, and electrolytic conditions in said tank are regulated in response to the detected value by way of control means.

16. A method for producing a colored stainless steel stock according to claim 15 wherein said coloring electrolyte solution is a mixed aqueous solution containing at least 0.5 mol/liter calculated as hexavalent chromium of a chromium compound and at least 1 mol/liter of sulfuric acid, and said alternating current electrolysis is conducted at an anodic current density of 0.01 to 3.0 $A/dm^2$, a cathodic current density of 0.03 to 5.0 $A/dm^2$, and a frequency of up to 100 Hz.

17. A method for producing a colored stainless steel stock according to claim 15 wherein said coloring electrolyte solution is an aqueous solution of 30 to 75 wt % sulfuric acid to which 0.5 to 15 wt % calculated as $MnO_4$- of a permanganate salt is added for reaction, and said alternating current electrolysis is conducted at an anodic current density of 0.01 to 0.1 $A/dm^2$, a cathodic current density of 0.01 to 0.1 $A/dm^2$, and a frequency of up to 10 Hz.

18. A method for producing a colored stainless steel stock according to claim 15 wherein said coloring electrolyte solution is a mixed aqueous solution of 1 to 10 wt % of a permanganate salt and 30 to 50 wt % of an alkali metal or alkaline earth metal hydroxide, and said alternating current electrolysis is conducted at an anodic current density of 0.01 to 0.5 $A/dm^2$, a cathodic current density of 0.01 to 0.5 $A/dm^2$, and a frequency of up to 100 Hz.

19. A method for producing a colored stainless steel stock according to claim 15 wherein said coloring electrolyte solution is a mixed aqueous solution of 1 to 10 wt % of a permanganate salt, 30 to 50 wt % of an alkali metal or alkaline earth metal hydroxide, and 1 to 5 wt % of manganese dioxide, and said alternating current electrolysis is conducted at an anodic current density of 0.01 to 0.5 $A/dm^2$, a cathodic current density of 0.01 to 0.5 $A/dm^2$, and a frequency of up to 100 Hz.

20. A method for producing a colored stainless steel stock according to claim 15 wherein said coloring electrolyte solution is a mixed aqueous solution containing 0.5 to 2 mol/liter calculated as hexavalent molybdenum of a molybdenum compound, 1 to 5 mol/liter of sulfuric acid, and 0.5 to 2 mol/liter calculated as hexavalent chromium of a chromium compound, and said alternating current electrolysis is conducted at an anodic current density of 0.01 to 0.5 $A/dm^2$, a cathodic current density of 0.01 to 0.5 $A/dm^2$, and a frequency of up to 10 Hz.

21. A method for producing a colored stainless steel stock according to claim 15 wherein said coloring electrolyte solution is a mixed aqueous solution containing 0.5 to 1.5 mol/liter calculated as pentavalent vanadium of a vanadium compound and 5 to 10 mol/liter of sulfuric acid, and said alternating current electrolysis is conducted at an anodic current density of 0.01 to 0.2 $A/dm^2$, a cathodic current density of 0.01 to 0.2 $A/dm^2$, and a frequency of up to 10 Hz.

22. A method for producing a colored stainless steel stock according to any one of claim 15 wherein said alternating current electrolysis is conducted in the alternating current electrolytic tank using a stainless steel stock as a counter electrode.

* * * * *